US008613130B2

(12) United States Patent
Larsen

(10) Patent No.: US 8,613,130 B2
(45) Date of Patent: Dec. 24, 2013

(54) FENCE APPARATUS AND RELATED METHODS

(76) Inventor: Charles Larsen, Huntington Beach, CA (US)

( * ) Notice: Subject to any disclaimer, the term of this patent is extended or adjusted under 35 U.S.C. 154(b) by 1249 days.

(21) Appl. No.: 12/162,987

(22) PCT Filed: Jan. 31, 2006

(86) PCT No.: PCT/US2006/003290

§ 371 (c)(1),
(2), (4) Date: Jul. 31, 2008

(87) PCT Pub. No.: WO2007/021304

PCT Pub. Date: Feb. 22, 2007

(65) Prior Publication Data

US 2009/0165281 A1 Jul. 2, 2009

(51) Int. Cl.
*B23P 11/00* (2006.01)
*B23P 17/00* (2006.01)

(52) U.S. Cl.
USPC ..... 29/525.13; 29/430; 256/21; 256/33

(58) Field of Classification Search
USPC ..... 29/430, 525.13, 525.14, 819; 256/21, 256/24, 32, 33, 45, 48; 211/106; 228/904; 140/1, 2, 7, 112
See application file for complete search history.

(56) References Cited

U.S. PATENT DOCUMENTS 553,306 A 1/1896 Fordyce
700,435 A 5/1902 MacLean
813,499 A * 2/1906 Johnson ..... 220/492
828,772 A * 8/1906 Patterson ..... 140/7
1,210,541 A * 1/1917 Ryker ..... 256/47
1,429,416 A 9/1922 Fade
1,641,872 A 9/1927 Southwell
2,245,584 A 6/1941 Harter
2,401,319 A * 6/1946 Roemer ..... 140/7
2,534,510 A 12/1950 Brickman
2,737,208 A 3/1956 Harter
2,835,223 A 5/1958 Erikson
2,968,470 A 1/1961 Pellerito et al.
3,396,761 A * 8/1968 Laswell ..... 140/112
3,421,177 A 1/1969 Broghammer (Continued)

FOREIGN PATENT DOCUMENTS

BE 1012179 6/2000
DE 1863758 12/1962

(Continued)

OTHER PUBLICATIONS

One webpage from: http://www.omegafence.com/evolution.html for Omega Fence Systems, Aug. 10, 2004.

(Continued)

*Primary Examiner* — David Bryant
*Assistant Examiner* — Christopher Koehler

(57) ABSTRACT

The present invention is directed to a fence or enclosure (165) and related methods for making a fence panel (65) and for connecting the panel (65) to other panels (65) to form a modular type fence (165). The invention preferably includes a generally planar section (70) of fencing material formed from spaced-apart wires (10, 15), and at least two non-parallel stiffening portions (80, 85) deforming the fence section (65) from the aforementioned generally planar configuration (70).

13 Claims, 37 Drawing Sheets

(56) References Cited

U.S. PATENT DOCUMENTS

| | | | | | |
|---|---|---|---|---|---|
| 3,469,822 | A | | 9/1969 | O'Brien | |
| 3,559,836 | A | | 2/1971 | Pink et al. | |
| 3,651,834 | A | | 3/1972 | Larkin | |
| 3,672,022 | A | * | 6/1972 | York | 428/593 |
| 3,719,358 | A | * | 3/1973 | Aaron | 482/36 |
| 3,732,899 | A | * | 5/1973 | Schindler | 140/112 |
| 3,848,323 | A | * | 11/1974 | Perger | 228/170 |
| 4,003,178 | A | * | 1/1977 | Douthwaite | 52/664 |
| 4,111,399 | A | * | 9/1978 | Hutchison, III | 256/32 |
| 4,422,622 | A | | 12/1983 | Broski, Jr. | |
| 4,553,740 | A | * | 11/1985 | Bailey | 256/33 |
| 4,558,851 | A | * | 12/1985 | Nakayama | 256/24 |
| 4,856,171 | A | * | 8/1989 | Croteau | 29/417 |
| 4,910,933 | A | | 3/1990 | Schwarzfeller et al. | |
| 4,911,209 | A | * | 3/1990 | Smith et al. | 140/112 |
| 4,917,047 | A | | 4/1990 | Wazeter, III | |
| 4,969,768 | A | | 11/1990 | Young | |
| 5,275,382 | A | | 1/1994 | Charbaut et al. | |
| 5,379,564 | A | * | 1/1995 | Wynne | 52/458 |
| 5,472,769 | A | | 12/1995 | Goerz et al. | |
| 5,542,649 | A | * | 8/1996 | Allegaert et al. | 256/54 |
| 5,623,791 | A | | 4/1997 | Schwarz | |
| 5,738,588 | A | * | 4/1998 | Esser | 472/92 |
| 6,095,713 | A | | 8/2000 | Doyle et al. | |
| 6,112,369 | A | | 9/2000 | Lindsey et al. | |
| 6,142,451 | A | | 11/2000 | Lindsey et al. | |
| 6,155,539 | A | * | 12/2000 | Nakayama | 256/21 |
| 6,367,781 | B1 | | 4/2002 | Flynn et al. | |
| 6,530,561 | B2 | | 3/2003 | Larsen et al. | |
| 6,553,940 | B1 | | 4/2003 | Powell et al. | |
| 6,581,914 | B2 | * | 6/2003 | Saura Sotillos et al. | 256/73 |
| 6,820,387 | B2 | * | 11/2004 | Sacks et al. | 52/660 |
| 7,100,642 | B2 | * | 9/2006 | Taboga | 140/7 |
| 7,478,798 | B2 | * | 1/2009 | Minelli | 256/24 |
| 2002/0027225 | A1 | * | 3/2002 | Saura Sotillos et al. | 256/67 |
| 2005/0247368 | A1 | * | 11/2005 | Taboga | 140/112 |

FOREIGN PATENT DOCUMENTS

| | | |
|---|---|---|
| DE | 3309542 | 12/1983 |
| DE | 3824721 | 4/1990 |
| DE | 19608304 | 8/1997 |
| DE | 10139872 | 10/2002 |
| DE | 2004 003897 U1 | 7/2004 |
| EP | 0098328 | 1/1984 |
| EP | 0368778 | 5/1990 |
| EP | 0481100 | 4/1992 |
| EP | 905336 | 3/1999 |
| ES | 2154181 | 10/1998 |
| FR | 2529935 | 1/1984 |
| FR | 2554156 | 5/1985 |
| FR | 2555639 | 5/1985 |
| FR | 2611428 | 9/1988 |
| FR | 2735171 | 12/1996 |
| FR | 2829409 | 3/2003 |
| GB | 1032475 | 6/1966 |
| GB | 1180528 | 2/1970 |
| GB | 2167786 | 6/1986 |
| GB | 2400120 | 10/2004 |
| NL | 1027161 | 4/2006 |

OTHER PUBLICATIONS

Two webpages from: http://www.quickfence.com/usa/index.jsp; Steel Fence, Mar. 9, 2004.

Two pages from http://www.cawire.com Cal Wire Wire Mesh Products and Four pages of related material printed from Adobe Acrobat from same site re: CAL WIRE type 101 Construction Woven Wire Industrial Partitions and CAL Wire type 202 Costruction Welded Wire Industrial Partitions, Aug. 10, 2004.

1 webpage from http://www.deacerofence.com/home/ for Deacero Fence and 2 pages of related materials from same site re: Deacero Bracket Assembly and Fence Assem. (3 pgs. total), 2007.

1 webpage from: http://www.omegafence.com/htm/evolution.html for Omega Fence Systems, Jul. 2007.

1 webpage from: http://www.quickfence.com/usa/index.jsp for Quickfence and 3 pages of related materials from same site re: Installation Instructions. (4 pgs. total), Mar. 9, 2004.

* cited by examiner

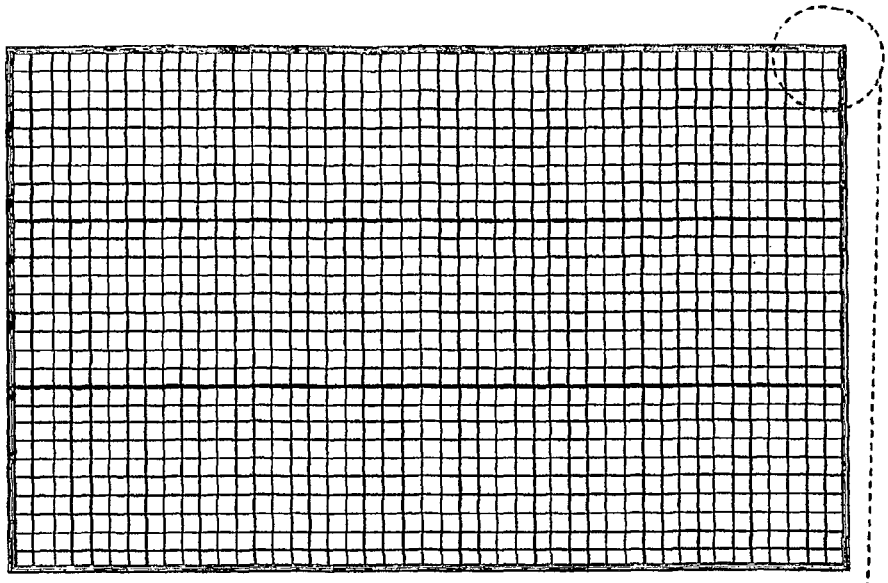
FIG. 33(a)
Figure 33(b)
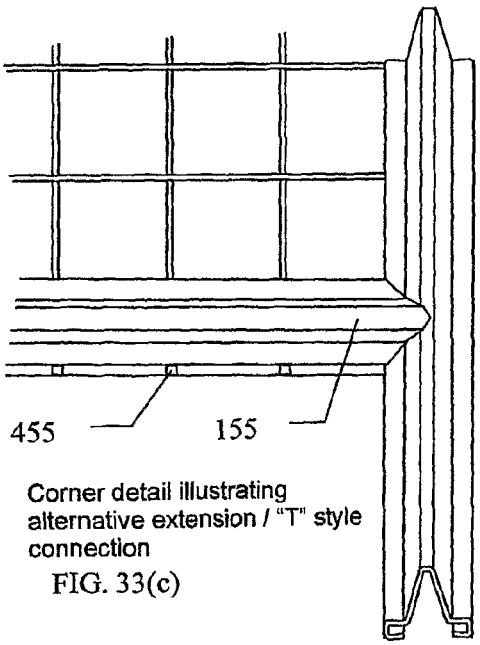
Corner detail illustrating alternative extension / "T" style connection
FIG. 33(c)
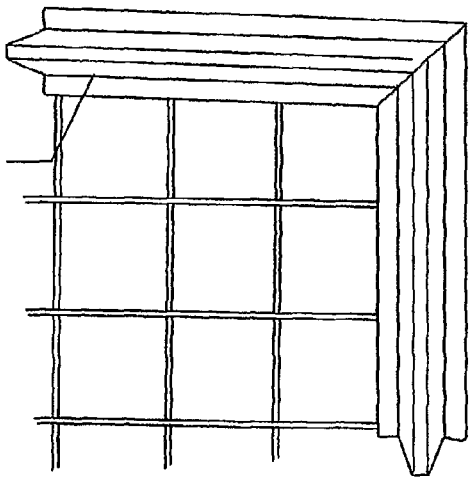
FIG. 33(b)
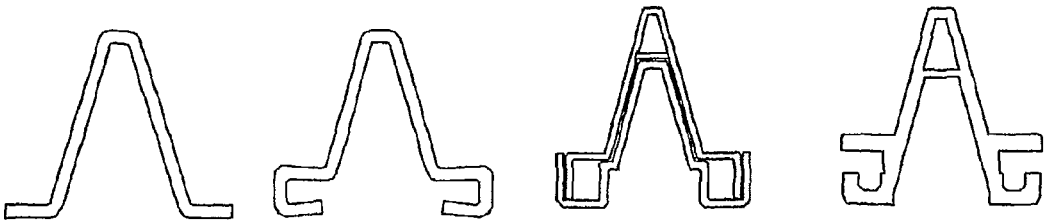
(d) (e) (f) (g)

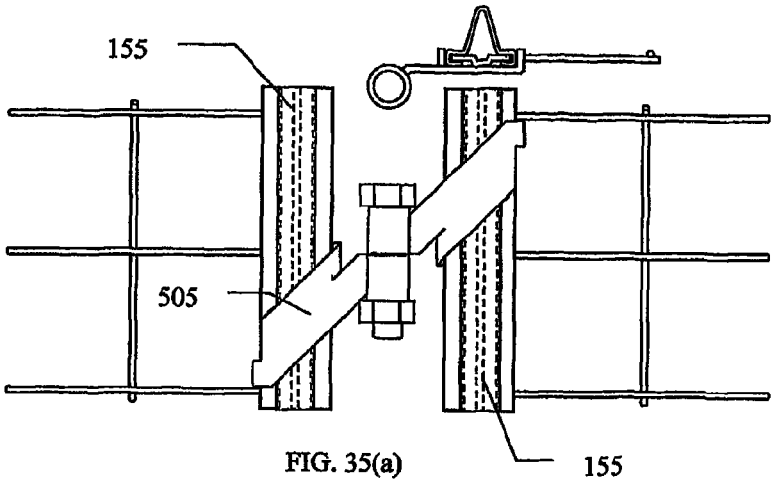
FIG. 35(a)
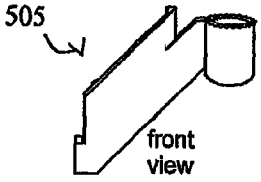
FIG. 35(b)
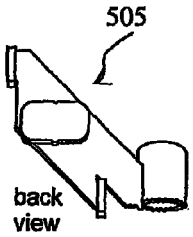
FIG. 35(c)
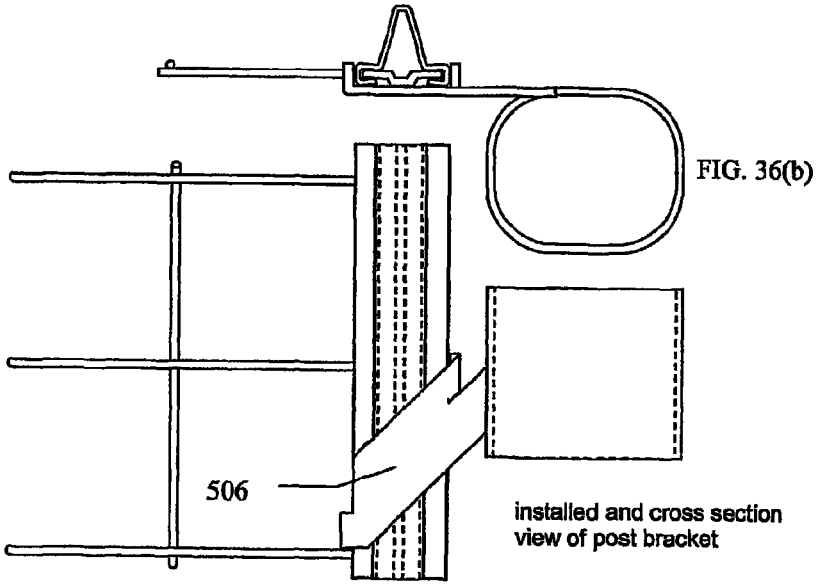
FIG. 36(b)
FIG. 36(a)
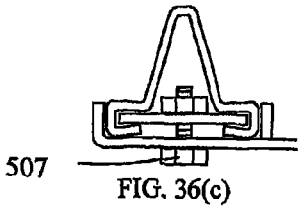
FIG. 36(c)
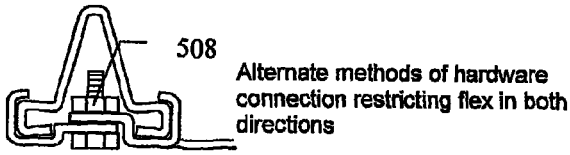
FIG. 36(d)

FENCE APPARATUS AND RELATED METHODS

CROSS-REFERENCE TO RELATED APPLICATION

This application claims priority to PCT application serial no. PCT/US05/29132 filed Aug. 17, 2005 which claims priority to U.S. application Ser. No. 10/920,650 filed Aug. 18, 2004.

FIELD OF THE INVENTION

The present invention relates generally to a fence structure. More particularly, the present invention relates to a generally planar fence panel having surface stiffening means that provide for, among other things, improved strength-to-weight characteristics, nesting and convenient packaging of a plurality of similar panels, and related methods of manufacture.

INCORPORATION BY REFERENCE

The contents of each U.S. patent or other reference, if any, cited in this application, are hereby incorporated by reference.

BACKGROUND OF THE INVENTION

A wide range of fence types are available for residential and commercial applications including, among other uses, an enclosure; boarding, or containment structure such as a cage, pen, or kennel; a boundary element for a yard, playground, or prison; crowd control; safety and security applications; and many others.

These fence types may include the quintessential "white picket fence" constructed of wood or plastic, but also commonly include some variation of a reticulated wire or wire mesh panel made of metal. For metal fences, the choice of metal typically is dependent on a number of factors including strength-to-weight-ratio, corrosive resistance, ease of maintenance, and visual appeal. In some applications, the metal wire may include a plastic or rubber coating.

Metal fences already exist with horizontal bends in the mesh fence. Those bends can add structural rigidity to the mesh, in the horizontal direction. Bending the fence in this way to add structural rigidity is generally a relatively less expensive and stronger alternative than, for example, using larger diameter wire. Among other alternatives to further increase rigidity and strength, a second horizontal wire or set of wires may be positioned parallel to the first set of horizontal wires. These practices (bending and/or extra wires) can avoid or reduce the necessity and costs of using a horizontal tubular rail or other bracing to provide stiffness in the fence.

For metal or other types of fences, vertical rigidity in fencing is typically achieved by attaching the fence material to a post or frame connected to a footing secured to the ground or other fixed object. Generally, one or more collar-type connectors or other fastening devices facilitates attachment of the fence material to the post.

Another type of fence that provides substantial horizontal and vertical rigidity can be described as "framed wire fence panels." These generally include an exterior frame fabricated from tubular metal posts or similar relatively heavy material, with wire mesh mounted within and covering the interior area enclosed by the frame. Although relatively stiff and although they provide various benefits, such wire frame panels have a number of drawbacks. For example, the manufacture of framed wire fence panels is generally considered labor intensive (and therefore relatively expensive), since the process involves manually attaching the wire mesh fill to the framing material. In addition, frames such as the familiar tubular type post used in many applications substantially increase freight weight, handling difficulty, and bulkiness, which typically results in greater shipping costs for less fence length when compared to a fence panel without such bulky posts. Even if the tubular posts/frames are shipped separately, the total shipping weight for the assembly remains the same (although under such a "ship unassembled" approach, the intensive labor needed to assemble the fence is left to the end user). The manufactured wire fencing is commonly packaged in rolls, or cut into sheets or panels prior to shipping.

The present invention addresses some or all of these problems (among other potential benefits of the invention). As explained herein, various embodiments of the invention can provide a fence panel having, among other things, improved shipping efficiency (nestability), strength-to-weight characteristics, and handling capabilities when compared to existing fence designs known to the inventor. These and other advantages of the apparatus and methods of the present invention will become readily apparent to persons of ordinary skill in the art, by reading the following disclosure of the invention and viewed in light of the accompanying figures.

SUMMARY OF THE INVENTION

One embodiment of the invention describes a fence and related method for making a fence panel, and for connecting the panel to other panels to form a modular type fence. Preferably, one embodiment includes a generally planar surface or body portion, and at least one generally non-parallel stiffening portion formed in the body portion. Each stiffening portion may include at least one wire or a bend added to the body, or a combination of wire(s) and bend(s) to provide rigidity and strength in at least two directions along the generally planar body portion. In many applications, the wires or bends eliminate the need for at least the vertical stability provided by bulky posts. Accordingly, various embodiments provide improved shipping efficiency, strength-to-weight characteristics, and handling capabilities when compared to fence designs known to the inventor.

The modular fence design/applications may include a second panel that can be joined to the first panel by a joining device. In contrast to many fence connectors, the preferred joining device of the present invention preferably permits use of a single attachment device for either of two types of selective connections between the panels: (*a*) rotating or (*b*) non-rotating joining between adjacent fence panels. The versatility of this type of joining device increases product efficiency by simplifying assembly, packaging, inventory control, and manufacturing overhead (less parts have to be designed and manufactured, etc.), and also greatly enhances assembly options.

For the purpose of summarizing the invention, certain objects and advantages have been described. It is understood that not all such objects or advantages may be achieved in accordance with any particular embodiment of the invention. Thus, for example, those skilled in the art will recognize that the invention may be embodied or carried out in a manner that achieves or optimizes one advantage or group of advantages without necessarily achieving other objects or advantages.

These and other points will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

FIG. 3(*a*) is a section view of a fence panel showing one embodiment of a stiffening deformation, as it may be formed using the cuts and bends shown in FIG. 3.

FIG. 10(*b*) is a top view of the fence panel of FIG. 10(*a*), and FIG. 10(*c*) is an end view of the fence panel of FIG. 10(*a*).

FIG. 15(*a*) is an elevation view of a preferred bolt assembly that may be used in joining devices such as those of FIG. 15.

FIGS. 35(*a*)-(*c*) show further variations of brackets or joining devices in accordance with other embodiments of the present invention.

FIGS. 36(*a*)-(*d*) show further variations of brackets or joining devices in accordance with other embodiments of the present invention.

DETAILED DESCRIPTION

Figure 1:
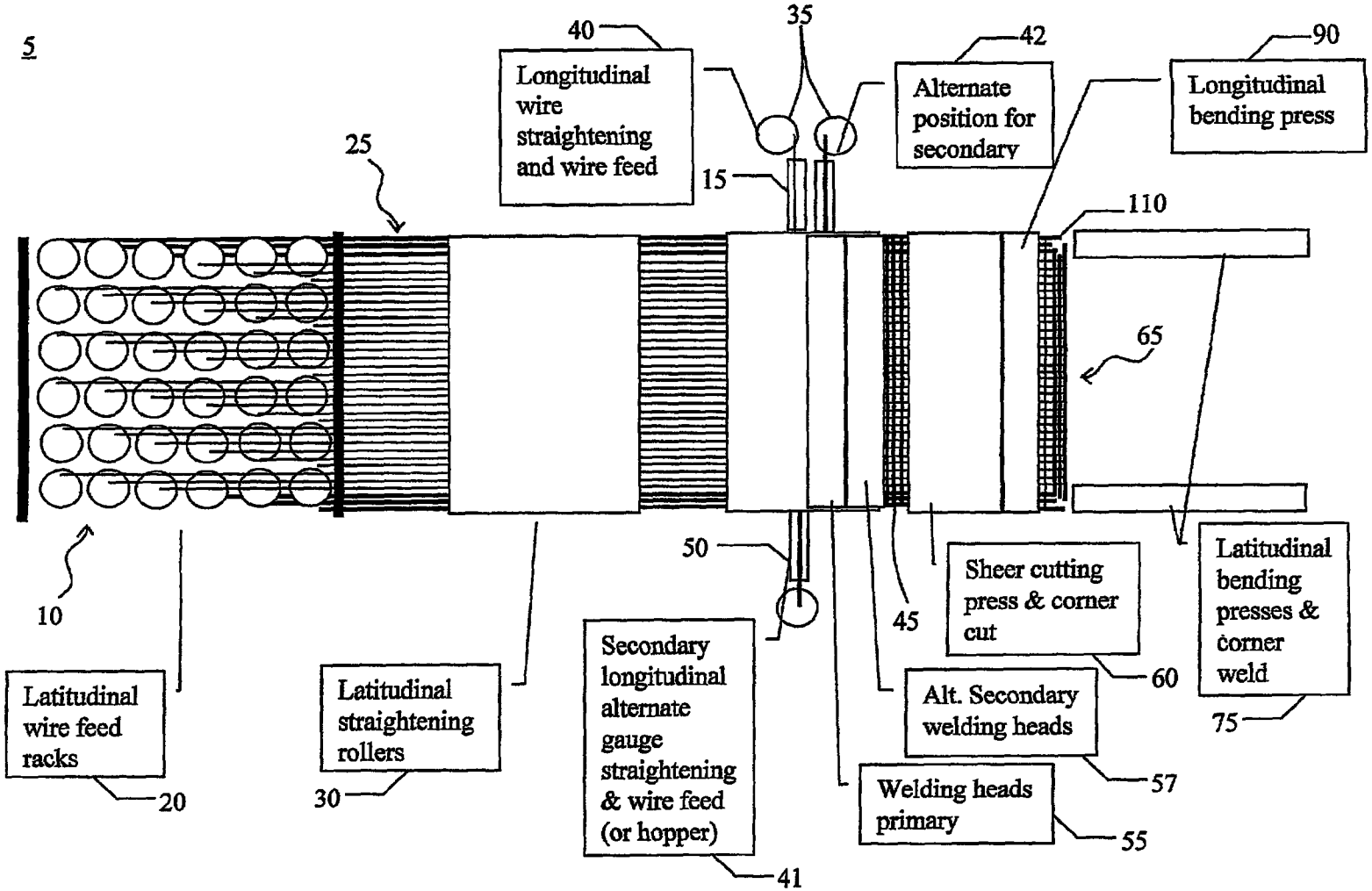
FIG. 1 illustrates one method of fabricating a fence panel having a generally planar surface and at least two generally non-parallel stiffening portions formed in accordance with one embodiment of the present invention.

Embodiments of the present invention will now be described with references to the accompanying Figures, with like reference numerals referring to like elements throughout. The terminology used in the description presented is not intended to be interpreted in any limited or restrictive manner, simply because it is being utilized in conjunction with a detailed description of certain embodiments of the invention. Furthermore, various embodiments of the invention (whether or not specifically described) may include novel features, no single one of which may be solely responsible for its desirable attributes or which may be essential to practicing the invention. The description herein and claims below are instead intended to describe and define the invention in a manner supporting the broadest scope of coverage to which the claims may be lawfully entitled.

General wire mesh or reticulated wire structure making methods such as those described in U.S. Pat. No. 2,401,319 to Roemer and U.S. Pat. No. 3,396,761 to Laswell are well-known in the art. Accordingly, those general teachings are incorporated by reference herein, and where applicable, various aspects of fence panel fabrication process or method are only briefly discussed herein.

As shown in FIG. 1 of the instant drawings, one fence panel fabrication/making method 5 of the present invention may include the various combinations of the following steps: (1) providing a first set of generally parallel spaced-apart wires, (2) providing a second set of generally parallel spaced-apart wires, (3) positioning the second set of wires transverse to the first set of wires to form points of transverse intersection between the first set of wires and the second set of wires, (4) connecting the first set of wires to the second set of wires along a plurality of points of transverse intersection, (5) cutting a portion of the first set of wires and the second set of wires, (6) removing the cut portion, and (6) bending the first set of wires and the second set of wires to form a generally planar section of fencing material formed from spaced-apart wires, and having at least two non-parallel bends deforming the fence section from the generally planar configuration to impart structural stability to the fence panel by placing at least one wire outside of the generally planar surface.

For convenience, each of the foregoing process or method steps is described in a particular sequence. For example, a first step may be recited as providing a first set of generally parallel spaced-apart wires. However, the invention can include methods that are subsets of the foregoing steps, and/or may involve those steps in a different order. By way of example, other methods of the invention may be practiced beginning after the first set of generally parallel spaced-apart wires is provided. Furthermore, the steps involved in any particular embodiment of the inventive method can be affected by the continuation, or interruption of other step(s) that were previously started. In other words, the precise steps within the various methods of the invention can be dependent on a number of factors, including the initial starting condition of the fence panel or any portion of the described fence panel and the system's desired final condition or state. By way of further examples, the process may begin by connecting the first set of wires to the second set of wires or the process may begin by bending the first set of wires and second set of wires to form a fence panel as described herein. Therefore, although a process or method is described with steps occurring in a certain order, the specific order of the steps, or any continuation or interruption between steps, is not necessarily required.

As further shown in FIG. 1, the steps of providing a first set of generally parallel spaced-apart wires 10 and a second set of generally parallel spaced-apart wires 15 preferably include latitudinal and longitudinal wires fed from racks. A first set of spaced apart wires 10 (latitudinal) is preferably fed from a plurality of racks 20 and traverse a pathway along a forming apparatus 25 that may include, among other features, latitudinal straightening rollers 30. If utilized, the straightening rollers 30 preferably align or adjust the wire to eliminate any waviness remaining in the wires after being unwound from the racks 20 or spools.

Also preferably, a second set of spaced-apart wires 15 (longitudinal) is similarly fed from a plurality of racks 35 and straightened 40 prior to being positioned relative to the latitudinal wires 10. In the preferred methods, the longitudinal wires 15 are positioned generally transverse to the latitudinal wires 10 forming transverse intersections 45 in a generally planar wire surface. Among the many alternative methods of the invention, a plurality of longitudinal wires 15 may be straightened 40 and pre-cut (not shown) to a desired length and fed from a single rack (negating the use of a plurality of feeding and straightening devices).

Figure 31B:
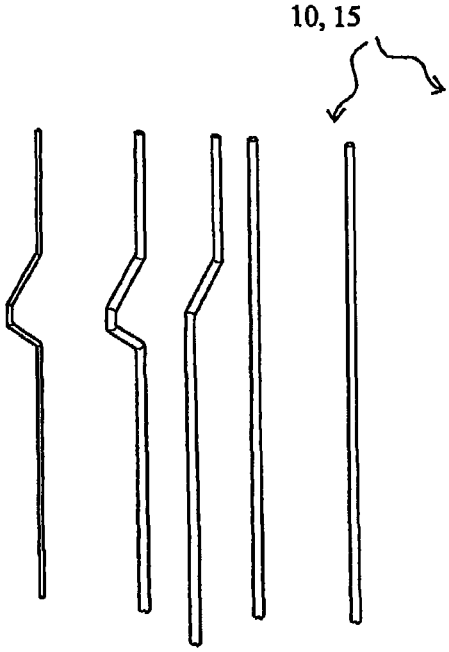
FIGS. 31(*a*)-(*c*) show individual wires that may be formed and bent prior forming the panel as described herein.
Figure 31C:
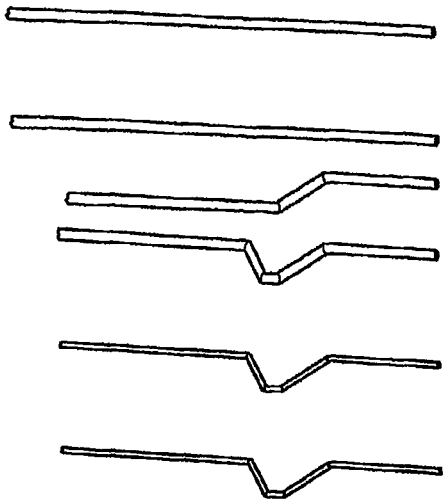
Figure 31A:
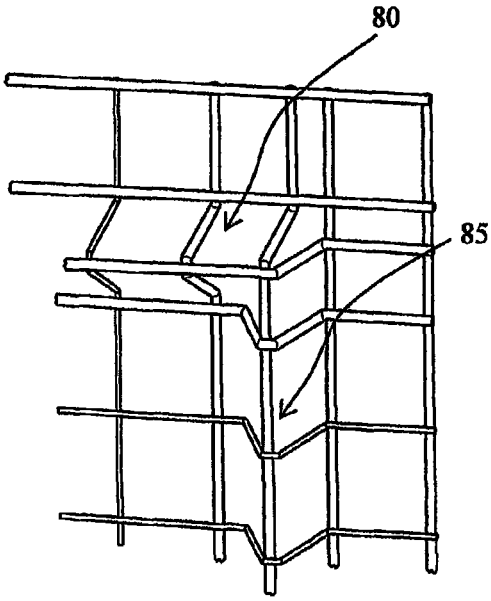
Figure 32A:
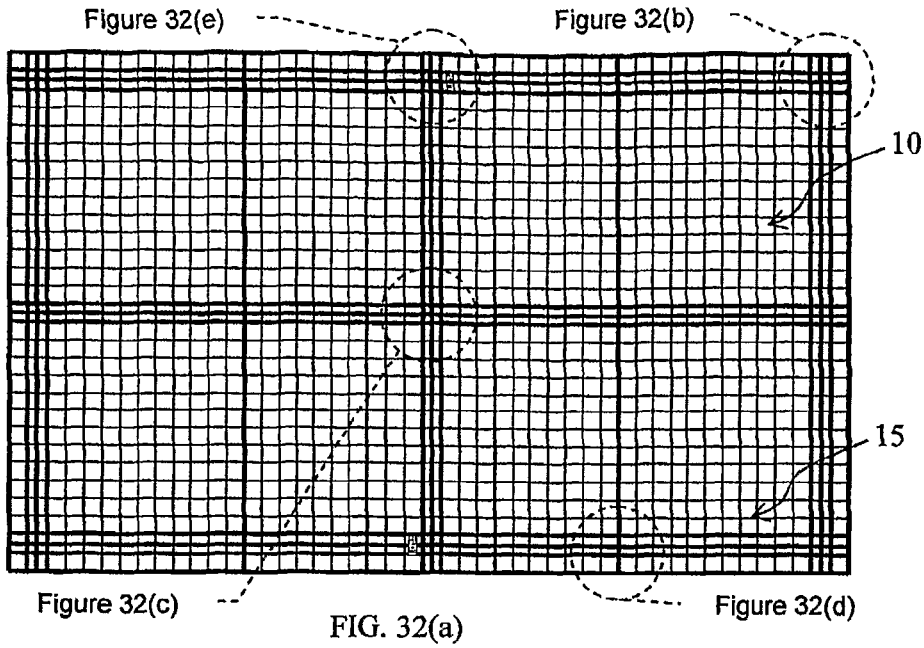
FIGS. 32(*a*)-(*e*) show a fence panel having a generally planar surface and at least two generally non-parallel stiffening portions deforming the fence section from the generally planar configuration, all in accordance with one embodiment of the present invention.
Figure 32E:
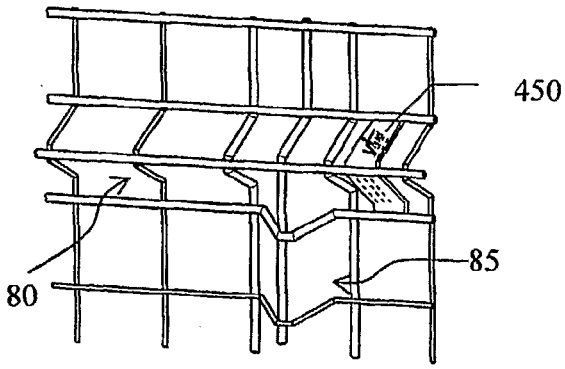
Figure 32B:
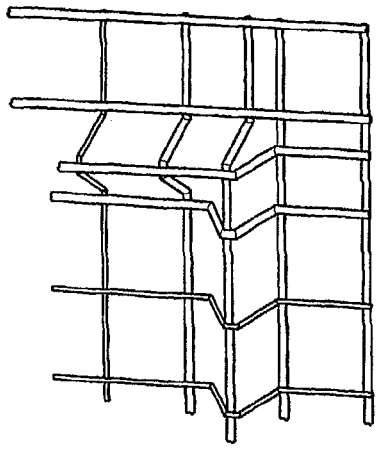
Figure 32C:
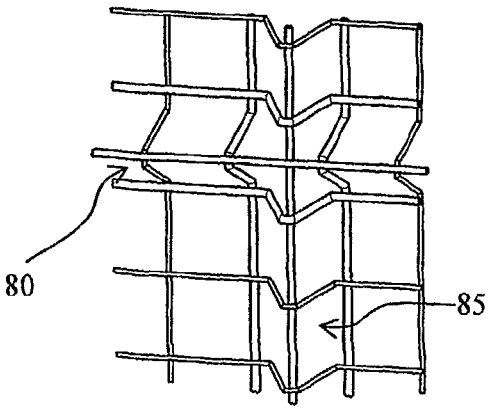
Figure 32D:
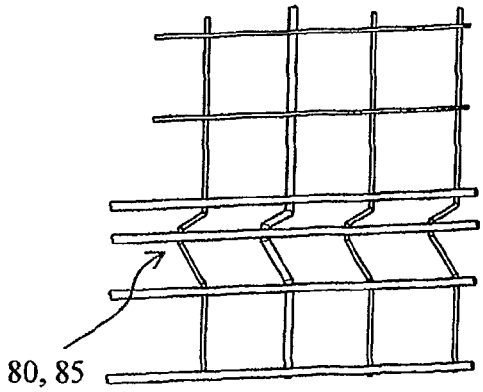
Figure 33H:
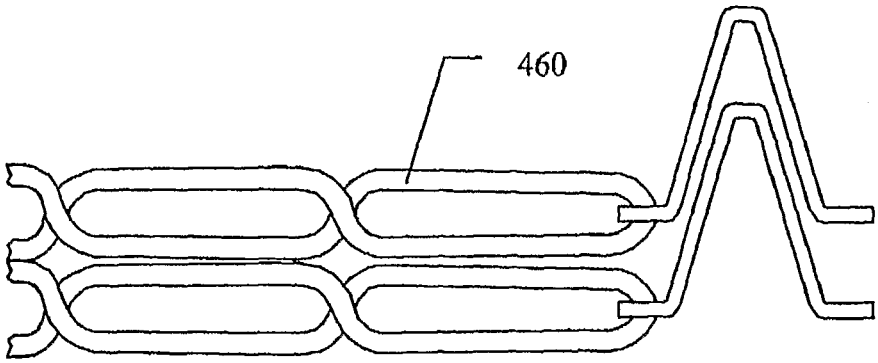
FIGS. 33(*a*)-(*l*) show various views of alternative embodiments of an insert and connection thereof to the spaced-apart wires that may be used alone or in combination with other stiffening means as described herein.
Figure 33I:
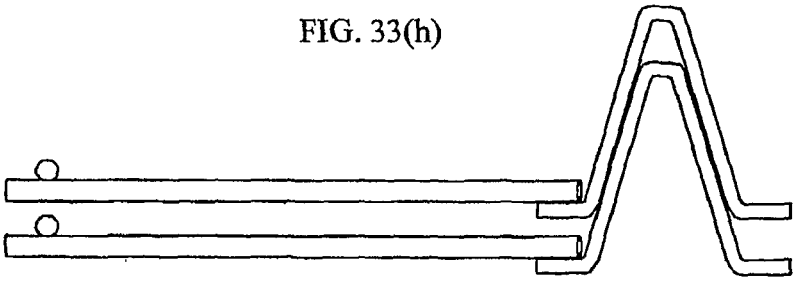
Figure 33J:
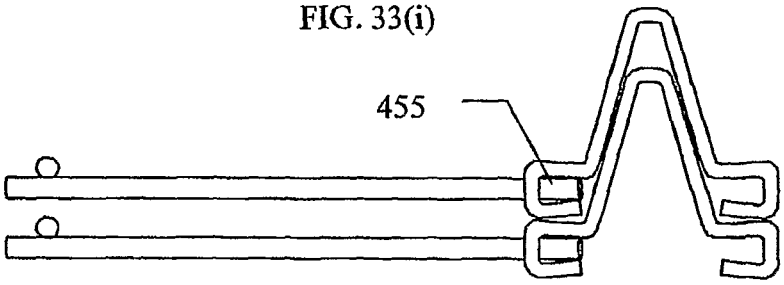
Figure 33K:
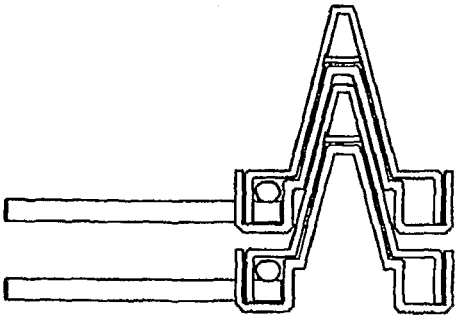
Figure 33L:
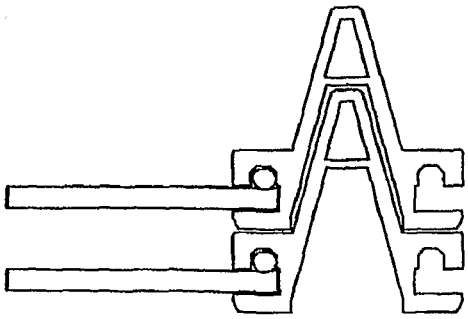
Figure 34A:
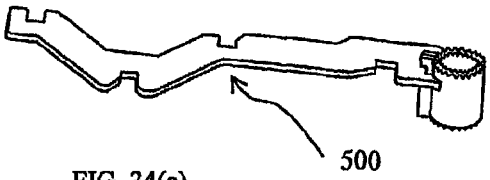
FIGS. 34(*a*)-(*e*) illustrate further variations of brackets or joining devices in accordance with one of the many other embodiments of the present invention.
Figure 34B:
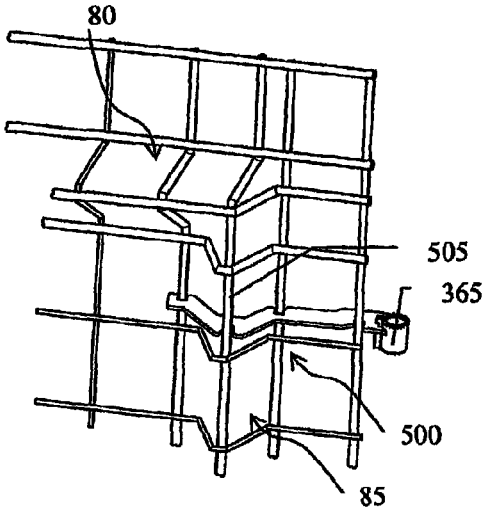
Figure 34C:
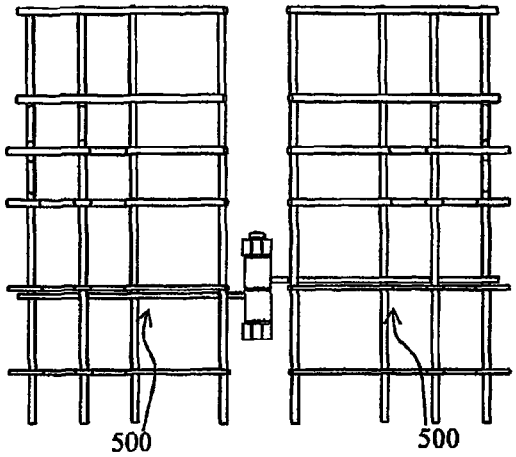
Figure 34D:
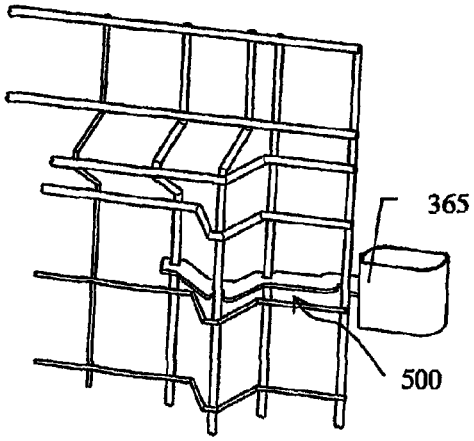
Figure 34E:
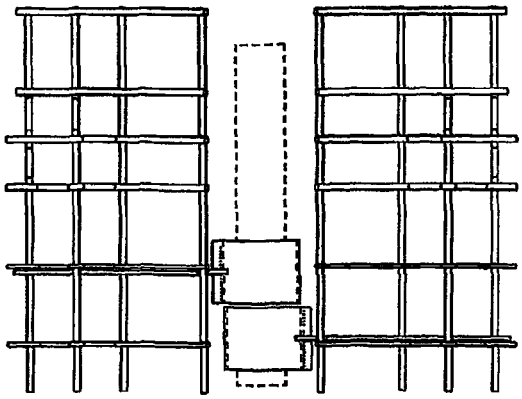
Figure 37A:
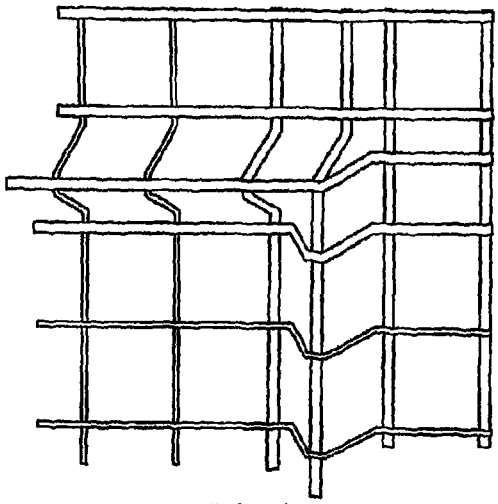
FIGS. 37(*a*)-(*d*) show various embodiments of a fence including a first panel having a first bend and a second bend formed by spaced-apart wires in the a generally planar surface.
Figure 37B:
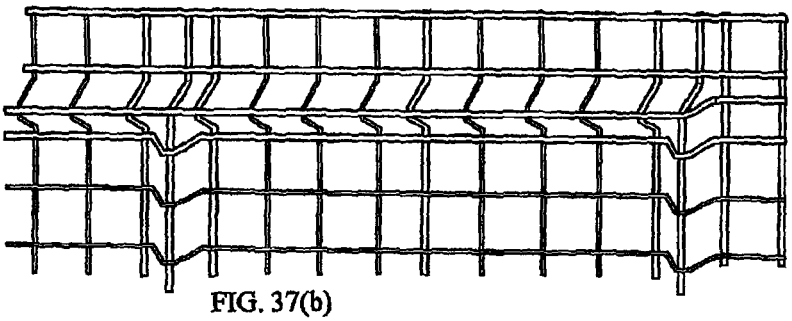
Figure 37C:
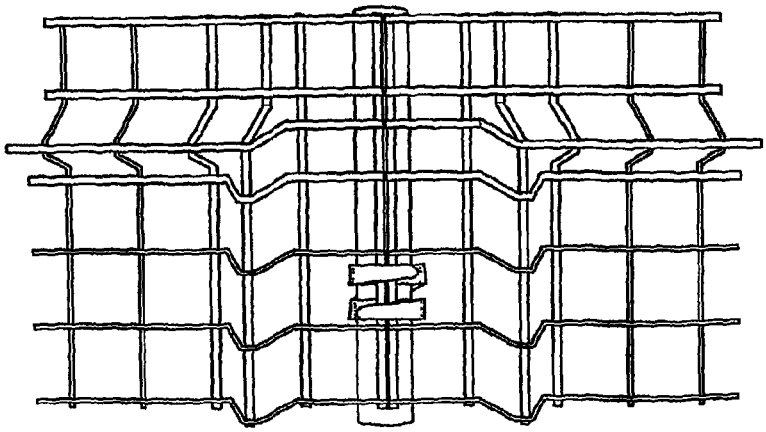
Figure 37D:
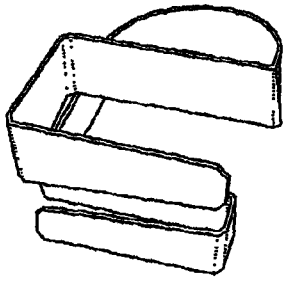

As shown in FIGS. 31(*a*)-(*c*), in an alternative embodiment, latitudinal and/or longitudinal wires 10, 15 may be preformed with bends, then individually set in place, and connect together via welding or other means at intersecting points between the latitudinal and longitudinal wires 10, 15 to form a fence panel having a generally planar surface formed by spaced apart wires, and a first bend and a second bend formed in the surface.

The latitudinal and longitudinal wires 10, 15 of each set also preferably are periodically spaced an equal distance from other wires within the set, and may further include wire(s) of different gauge 50 periodically spaced from each other. The different gauge wire(s) 50 may be fed from at least one rack 41, 42 located along the forming apparatus 25.

In a preferred embodiment, smaller gauge wire (larger diameter) forms at least a section of at least one stiffening portion formed within the fence panel. Persons of ordinary skill in the art will understand that the exact number and spacing/location of the latitudinal, longitudinal, and alternative wire gauge racks 20, 35, 41, 42 can be in any convenient position and configuration, and may vary depending on various manufacturing and application requirements. Furthermore, the exact angle of transverse intersection between the first set of wires 10 and the second set of wires 15 as well as the gauge and periodic spacing of wires within the first set and/or the second set 10, 15 will depend on various factors, including, among other things, the fence panel's intended residential or commercial or other application. For example, in one embodiment, at least some of the spaced-apart wires 10, 15 traverse one another at an approximate right angle.

Persons of ordinary skill in the art will understand that the invention can be practiced with any suitable materials and a variety of suitable fabrication methods, including ones other than metal (such as plastics) and ones other than welding (such as gluing or injection molding or the like). Preferably, however, welding heads 55 connect/weld the first set of wires 10 to the second set of wires 15 by well-known welding methods along a plurality of points of transverse intersection 45. Welding heads 55 may programmatically adjust to accommodate the variance of the heavier gauge wire 50. Alternatively, a secondary set of welding heads 57 may be incorporated to weld the intersections 45 of the heavier gauge wire 50.

Certain metal wire types or other materials may require specialized joining methods. Likewise, and as indicated above, plastic wire panels having latitudinal and longitudinal or otherwise transverse wire sets may be prefabricated as a single integral piece, or as individual wire sets transversely positioned to each other and joined by heating or similar bonding methods.

In one embodiment, the joined-together wire assembly (comprising the first and second set of spaced-apart wires 10, 15) is periodically cut to a desired length by a sheer cutting press 60.

In the preferred forming process 5, the generally planar surface is preferably bent by a bending press 90 to form at least one generally linear bend 80 substantially across the generally planar surface 70, such that the bend 80 is oriented in a substantially vertical direction when the fence panel 65 is erected. A second bend 85, generally oriented in the horizontal direction, may be added, for example, by a bending press 75 bending the fence panel 65 along the horizontal plane of the generally planar surface 70.

The bend(s) 80, 85 or other stiffening means, described herein, preferably impart structural stability to the fence panel 65 in at least the vertical direction. This preferably obviates, or at least reduces, the need for secondary support such as a post or frame connected to a footing secured to the ground or other fixed object.

The preferred bending of the generally planar section 70 of fencing material in at least two directions results in a fence panel 65 having at least two non-parallel bends 80, 85 deforming the fence section 65 from the generally planar configuration 70. During the forming process 5, the spaced-apart wires 10, 15 may be woven (not shown) to form a generally planar section of mesh. The wire mesh of such alternative embodiments also preferably includes at least two non-parallel bends deforming the mesh section from the generally planar configuration.

As used herein, the term "generally planar" is a broad term generally used in its ordinary meaning, "a surface at which the curvature is zero", and pertains to the overall surface appearance regardless of whether irregularities or bends form a portion of that overall surface appearance. For example, a woven reticulated or netlike wire mesh fence typically includes wires periodically bent to accommodate the fence's woven features. However, the overall surface appearance of such a fence is considered "generally planar" within the context of the present invention.

Accordingly, certain embodiments of the invention may be described as providing or comprising a fence section having a generally planar body portion 65, and at least two generally linear non-parallel deformed stiffening portions 80, 85 formed in the body portion 65. The preferred stiffening portions 80, 85 are deformed so as to be distinct from the majority of the generally planar body portion 65.

Alternatively, the invention may be described as a fence construction having a generally planar body portion 65 forming the majority of the area of the construction, and at least two generally linear non-parallel deformed stiffening portions 80, 85 formed within the body portion 65. In such alternative descriptions, the stiffening portions 80, 85 form a minority of the construction and preferably are distinct from the majority of the generally planar body portion 65.

As indicated above, the bends 80, 85 or other stiffening means preferably enhance structural stability/rigidity of the panel 65 in at least one linear direction. Strengthening the fence by incorporating bending into the body of the fence is generally a stronger and lighter-weight alternative than using larger diameter wire, and relatively less expensive (to manufacture, handle, store, and ship) than using a horizontal tubular post, rail, or brace to gain stiffness in the fence.

By eliminating or reducing the need for at least vertical stiffening or support such as a post, the fence panel 65, described herein, provides, among other things, improved shipping efficiency (nestability), and handling capabilities when compared to existing fence designs known by the inventor. This improved nestability is illustrated by comparing prior art systems in FIGS. 2(*a*) and 2(*b*) to the preferred nested stack of panels of the invention shown in FIG. 2(*c*).

Improved shipping efficiency is realized in the present invention because the bend(s) 80, 85 or stiffening means of one fence panel 65 is capable of relatively snugly fitting within another fence panel having a similarly shaped bend and/or stiffening means (nestability). Nestability of the present invention typically reduces the overall package dimension (for storing and/or transporting the panels of the invention) compared to fence panels having posts that are typically stacked or staggered to accommodate shipping. Due to the nestability of at least one embodiment of the present invention, more linear feet of fence panel can typically be shipped when compared to known stacked or staggered fence panels occupying the same space.

Figure 2C:
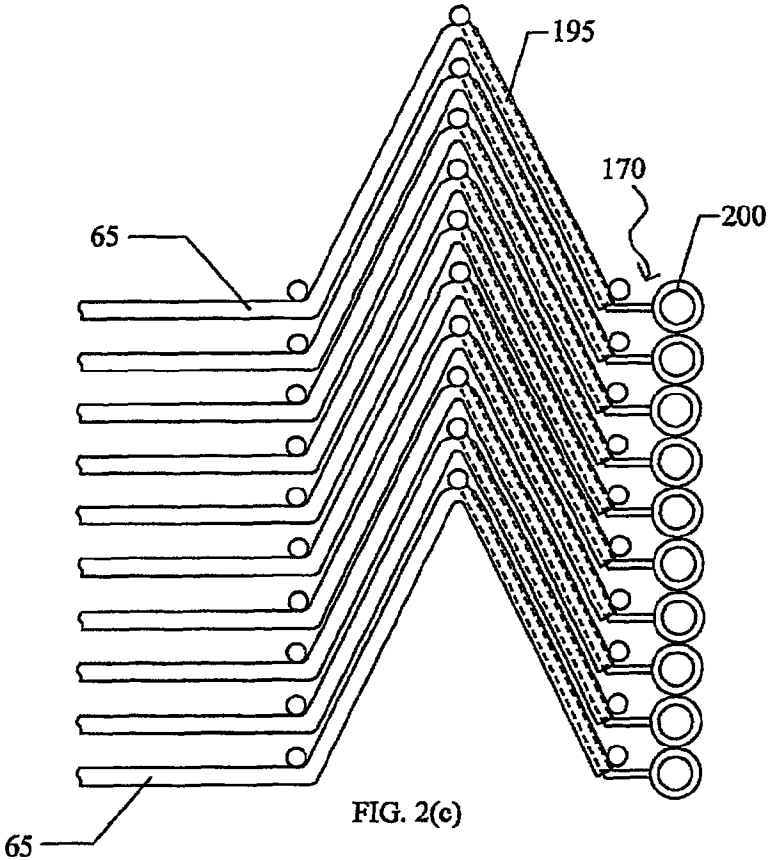
FIG. 2(*c*) shows nestable characteristics of one embodiment of the present invention compared to FIGS. 2(*a*) and (*b*), which illustrate alternative nesting arrangements or characteristics for a prior art fence panel having a post type vertical support. Preferred panel engagement elements 200 are shown in phantom in FIG. 2(*c*).
Figure 2A:
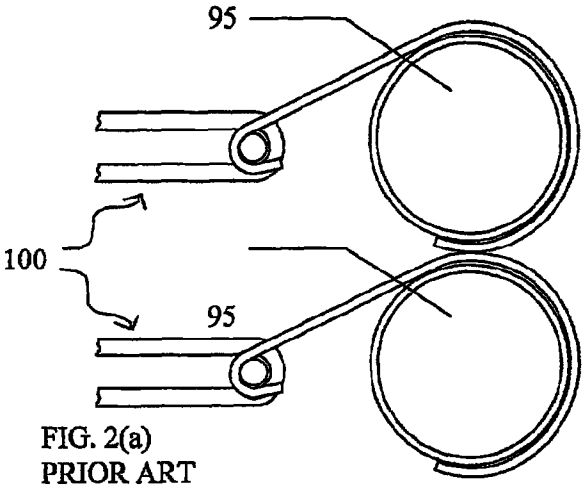
FIG. 2(a) PRIOR ART
Figure 2B:
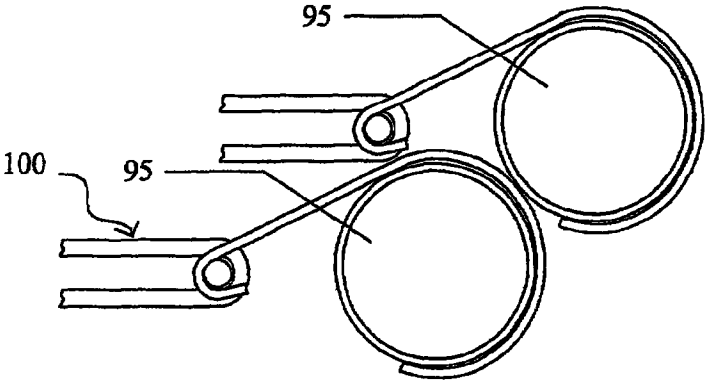
FIG. 2(b) PRIOR ART

In the examples shown in FIGS. 2(*a*)-(*b*), the tubular post supports 95 (such as those commonly shipped with many fence panels 100) can be stacked directly over each other or can be staggered, depending on support frame placement. Accordingly, each successively placed fence panel 100 increases the stacked or staggered packing height of known devices by approximately the diameter of the support frame 95. In contrast, according to one embodiment of the present invention shown in FIG. 2(*c*), each successively added fence panel only increases the packing height of the nested panels 65 by approximately the diameter (gauge) of the wires used in the panel. The exact packing space savings realized will depend on various factors, including, for example, wire gauge, bend height, sizing of optional engagement or joining device (which is indicated as phantom element 200 in FIG. 2(*c*)), and the total number of panels stacked together within a single package.

In addition to package dimensions (which can affect storage, handling, transport, display, and other economic aspects of fence panels generally), panel weight is typically another consideration or factor in analyzing shipping efficiency and cost. In this regard, frames such as the familiar tubular type post 95 used in many applications substantially increase freight weight, handling difficulty, and bulkiness, resulting in greater shipping costs for less linear fence length when compared to the panels such as panel fence 65 that can be achieved by the present invention. Even for prior art systems in which the tubular posts 95 are shipped separately, overall shipping weight remains the same while the intensive labor needed to assemble the fence is left to the end user.

Returning now to FIG. 1, the fence forming process 5 may further include cutting and removing a portion 110 of the first set of wires and the second set of wires 10, 15, and bending a portion of the first set and second set of wires 10, 15 to form a fence panel 65 as generally described herein. If the fence panel is only going to be bent in a single direction or on a single axis (or in a manner so that no bends intersect with each other), there typically will not be a need to cut and/or remove any portion of the wires as described herein.

Figure 3A:
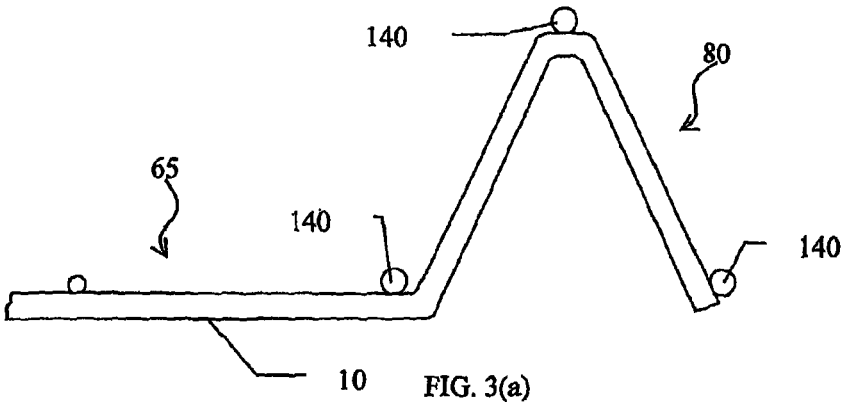
FIG. 3 illustrates preferred cuts and bends in a fence panel having a generally planar surface, to facilitate forming a junction or stiffening deformations therein in accordance with one embodiment of the present invention.
Figure 3:
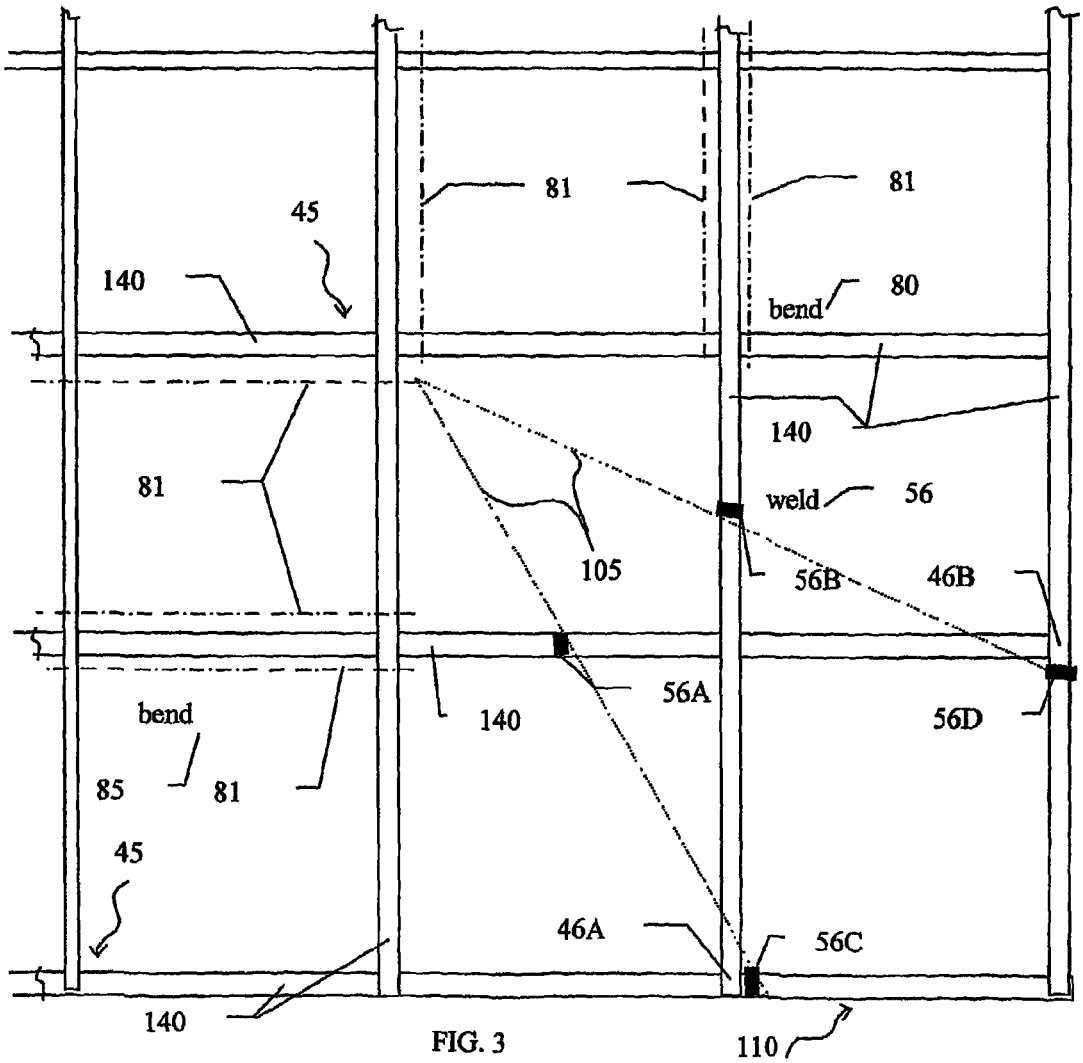
Figure 4:
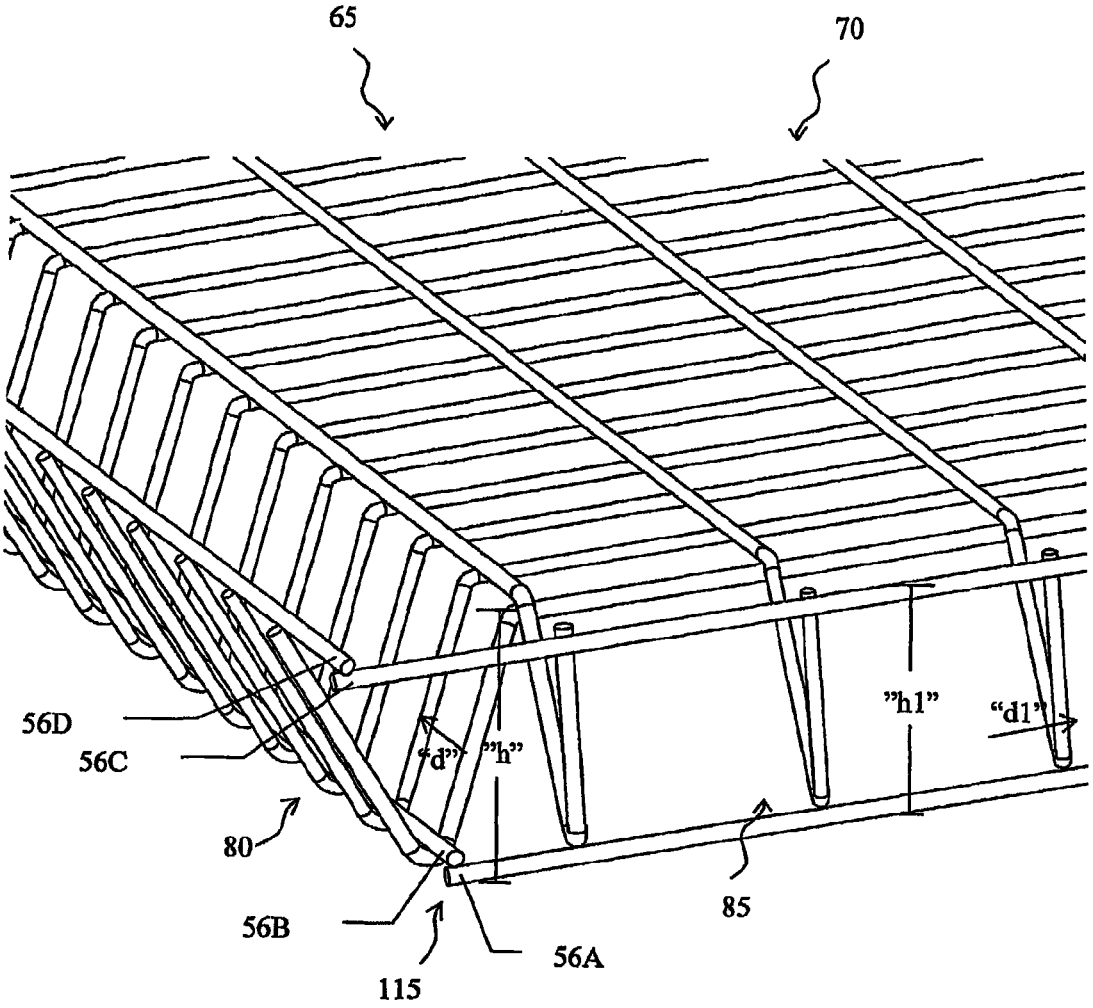
FIG. 4 is a perspective view of a fence panel having a generally planar surface and at least two generally non-parallel stiffening portions deforming the fence section from the generally planar configuration, all in accordance with one embodiment of the present invention.

For a preferred embodiment of the invention that incorporates a first bend 80 and a second bend 85, however, cutting at locations such as 56A-D along "cut lines" 105 and removing a portion 110 of the first set and second set of wires 10, 15, as shown in FIG. 3, facilitates formation of a junction 115 at the location where the first bend 80 and the second bend 85 intersect (see FIGS. 3 and 4). This cutting can be accomplished in any suitable manner, including manually or automatically. Preferably, it is part of an automated process such as illustrated in FIG. 1, in a step such as step 60. As explained further below, the precise locations of the cut lines 105 and the resulting cuts 56A-D can vary depending on the depths of the strengthening bends in the fence panel and other factors (for shallower bends, less material 110 would need to be removed). Selected transverse wire intersections 46A, 46B may not be welded during process by selectively programming welding heads 55, 57 to skip those intersecting sets of wires 45 further facilitating the removal of a portion of the wire 110.

Intersecting bends of different depths may be accommodated by altering the position of the cut lines 105 leaving the wires long enough to be angled up or down to meet the intersecting wire. Preferably the cuts improve the ease of forming intersecting bends in the panel, and allow the cut wires to be readily brought together at the intersecting bends in the fence panel (see FIG. 4) and even joined together at those locations by welding or the like.

Persons of ordinary skill in the art will also understand, however, that the preferred intersecting bends of the invention can be formed without any such cutting or removal of portions 110. Although such "uncut" embodiments are not illustrated, persons of ordinary skill in the art will understand that they would result in a similar final configuration, but that the material 110 would remain attached and would have to be folded/smashed into the intersection of the bends. In such embodiments, the folded material 110 might adversely limit the nestability of a plurality of similar panels, and might also affect the strength and other properties of the panel.

FIG. 3 also includes phantom lines 81 showing preferred breaklines or bendlines for forming the first bend 80 and the second bend 85 along the sides 130, 135 of the panel 65. Persons of ordinary skill in the art will understand that these are merely illustrative, and that the bends or other stiffening portions of the panel can be formed in any suitable manner, as discussed elsewhere herein.

Figure 16:
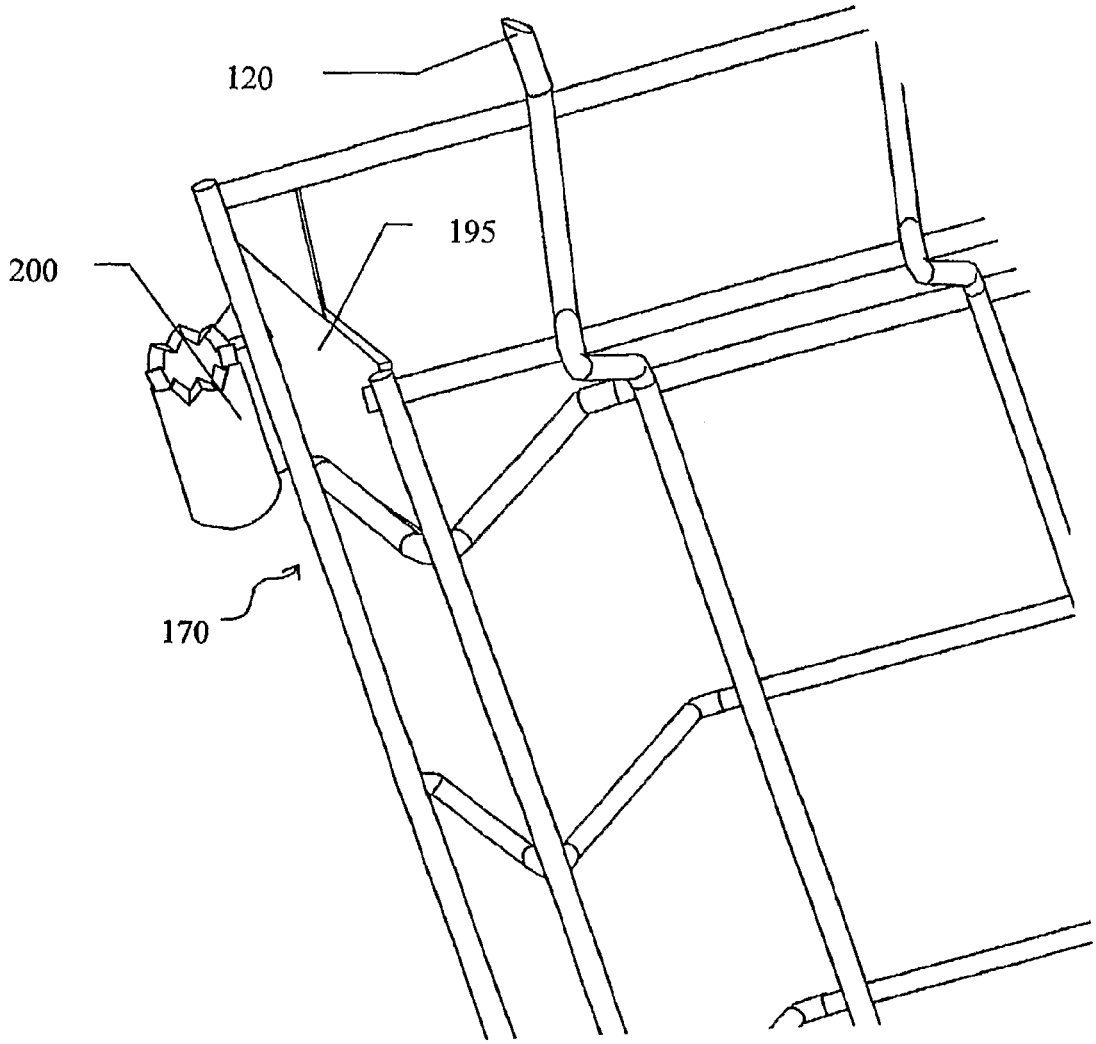
FIG. 16 illustrates the joining device of FIG. 15, as it may be positioned near the top of a fence panel.
Figure 21:
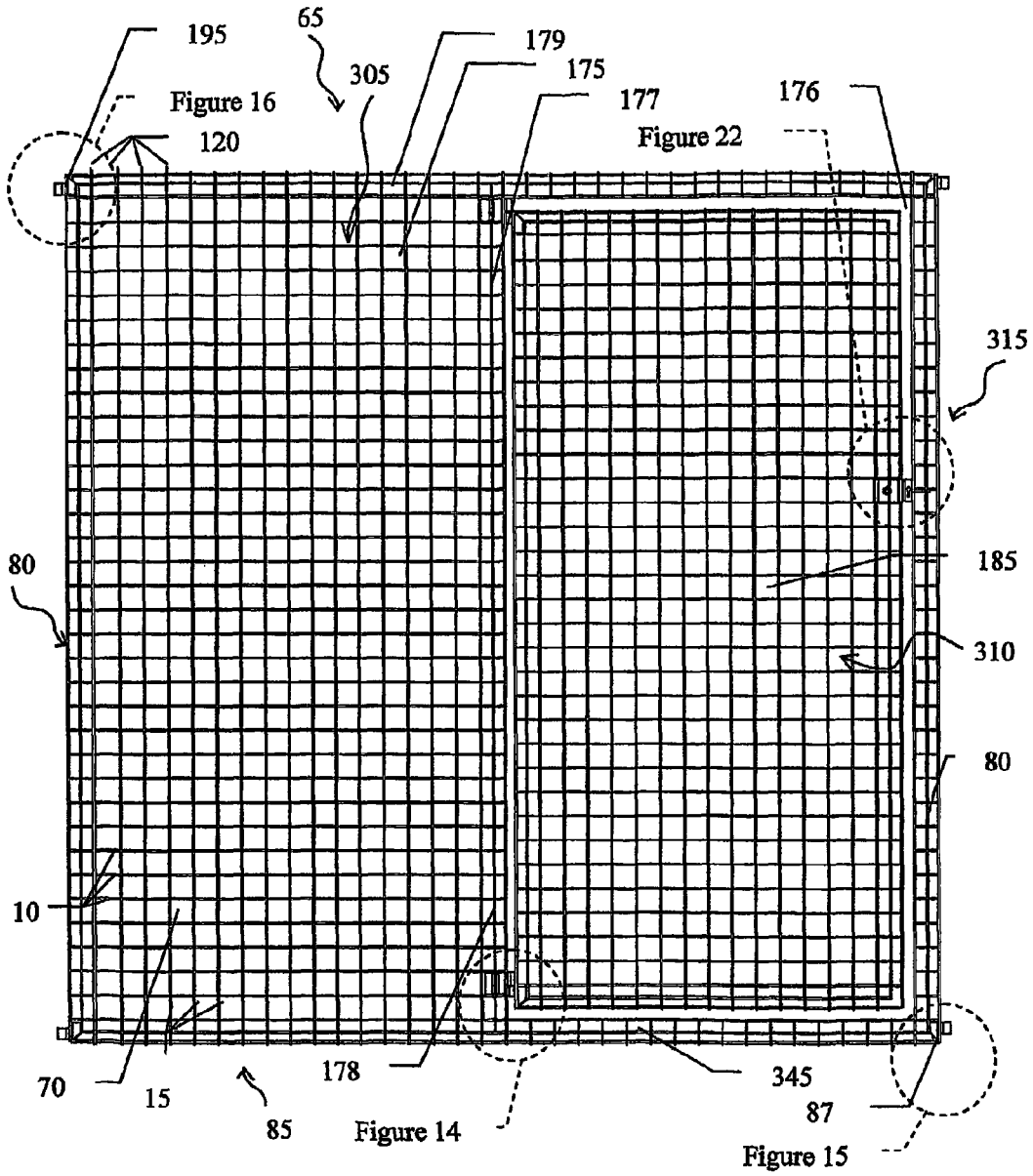
FIG. 21 is a side view of one embodiment of a fence panel assembly, having a plurality of joining devices positioned to provide selective rotating and non-rotating attachment of a first panel and second panel.

As shown in FIGS. 21 and 16, one or more of the first set and the second set of wires 10, 15 may also be cut or otherwise formed as a security extension 120 along at least a portion of one side of the fence panel 65. For example, positioning of a security extension 120 at the top of a fence panel 65 may act as a deterrent to potential trespassers (who might try to climb over the fence), while a security extension 120 positioned at the bottom (not shown) of a fence panel 65 may deter animals from accessing such areas as a garden or flower bed. Persons of ordinary skill in the art will understand that any suitable security extension may be used. Examples of such extensions include, among others, (a) attaching razor wire or barbed wire to the fence panel for more extreme applications, (b) simply allowing some or all of the panel wires in one direction to extend beyond an outermost transverse wire and/or cutting those extensions at an angle to provide somewhat sharp "points" that extend outwardly from the panel (see FIGS. 21 and 16), or (c) attaching other finer mesh grids or extensions.

Figure 5:
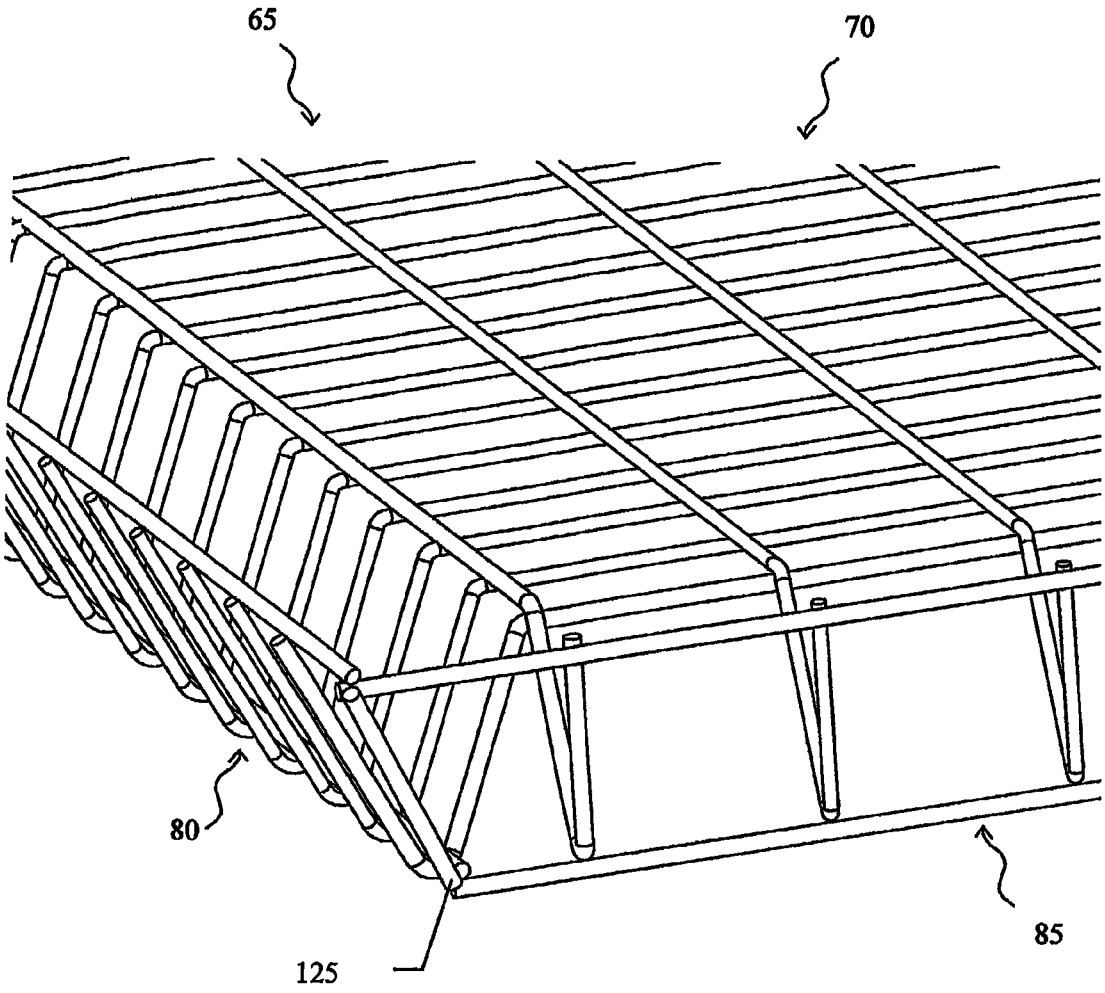
FIG. 5 is the fence panel of FIG. 4 further showing an optional support link 125 connected between spaced apart wires of a junction formed in the fence panel.

In one embodiment, as shown in FIG. 4, the fence panel 65 may include a first bend 80 (preferably having a substantially continuous uniform height "h" in a first linear direction "d") and a second bend 85 (preferably having a substantially uniform height "h1" in a second linear direction "d1"). In the preferred methods and apparatus of the invention, bending the planar surface 70 to form the first bend 80, the second bend 85, and the junction 115 between the first bend 80 and the second bend 85 typically causes each to protrude from the generally planar surface 70. The formed junction 115 may include an optional support link 125 connected between spaced-apart wires of the junction 115, as shown in FIG. 5. For metal embodiments, the link 125 typically would be added after the intersection of FIG. 4 has been formed.

Figure 6:
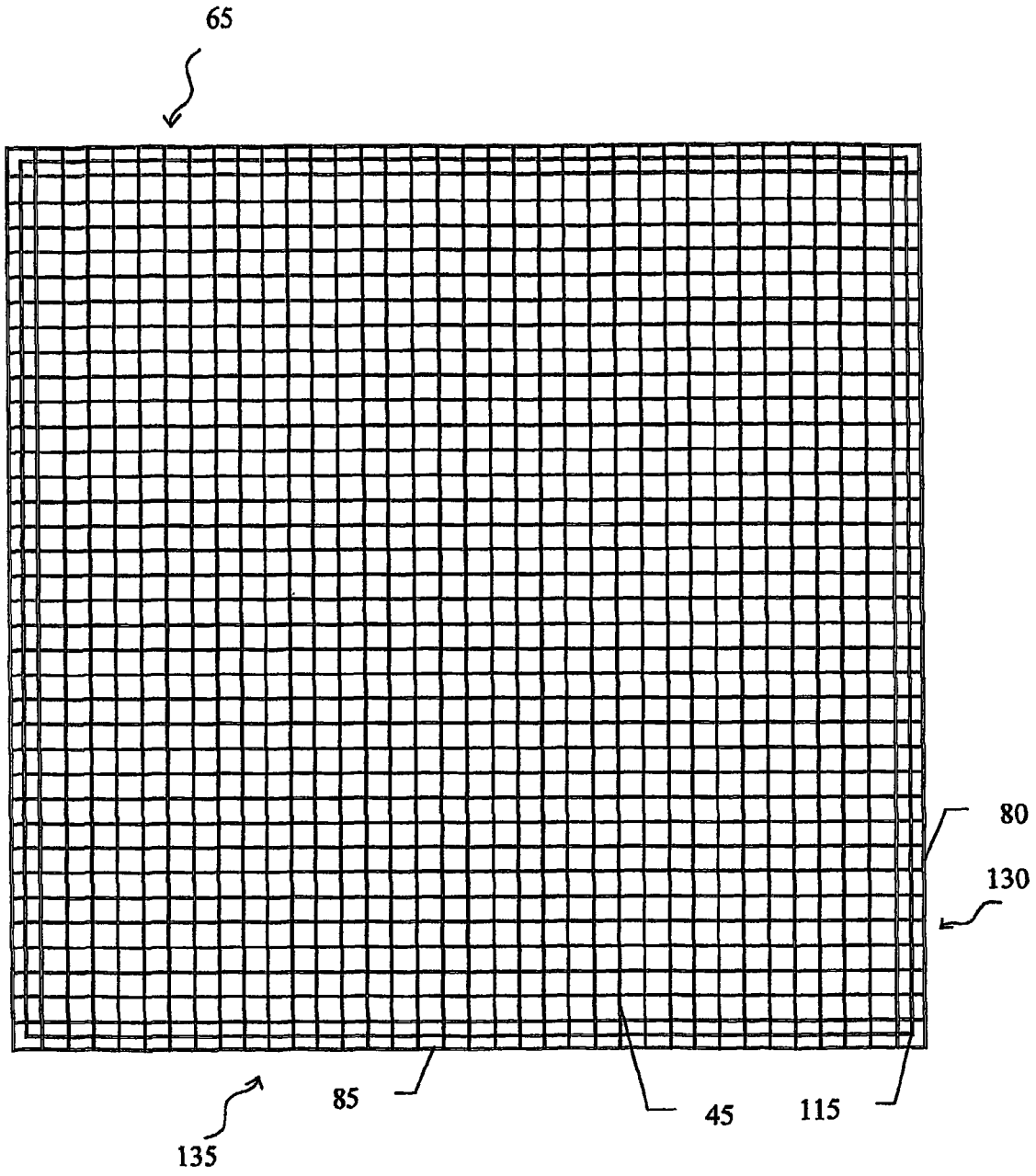
FIG. 6 is an elevation view of the fence panel of FIG. 4, as the panel might appear in an erected position.

As further shown in FIG. 5, the shape of the first bend 80 and the second bend 85 are each preferably substantially triangular in cross-section, and each bend 80, 85 has substantially the same height along its length. In addition, as shown in FIG. 6, preferably, the first bend 80 is located generally along a first edge 130 of the panel, and the second bend 85 is located generally along a second edge 135 of the first panel. As further shown in FIG. 6, the generally linear non-parallel deformed stiffening portions or bends 80, 85 preferably extend the entire length of a particular panel 65.

Alternatively, as shown in FIGS. 31(*a*) and 32(*a*)-(*d*), the first bend 80 may be located generally inset from the first edge 130 of the panel, and the second bend 85 may be located generally inset from the second edge 135 of the panel. As further shown in FIGS. 32(*a*)-(*d*), the first bend 80 and second bend 85 may form a portion of a bend generally inset from an edge of the panel (FIG. 32(*a*)), a portion of a bend inset and generally positioned near a corner of the panel (FIG. 32 (*b*)), a portion of a center cross bend located generally near the center of the panel (FIG. 32(*c*)), and a portion of a bend inset and generally extending the length of panel.

Persons of ordinary skill in the art will understand that the cross-sectional shape, length, non-parallel positioning (angle of separation/intersection), and path or continuation of any bend in any particular direction may vary according to a variety of factors including, among other things, the fence panel's intended residential or commercial application. Among other things, curvilinear bend paths could be utilized, and could even form aesthetic patterns within the panel or at its edges (as further discussed below, one such example is shown as the bottom pattern in FIG. 7(*b*)).

Figure 7A:
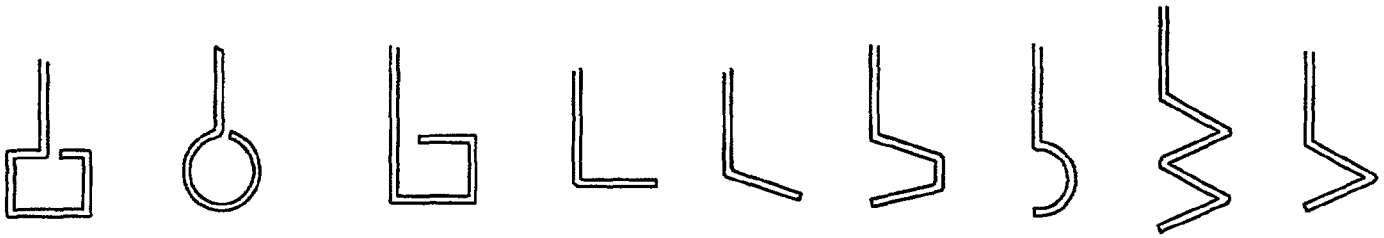
FIGS. 7(*a*)-(*b*) show some of the many alternative cross-sectional embodiments of the stiffening means and positioning thereof along a fence panel having a generally planar surface, that may be used in various embodiments of the invention.
Figure 7B:
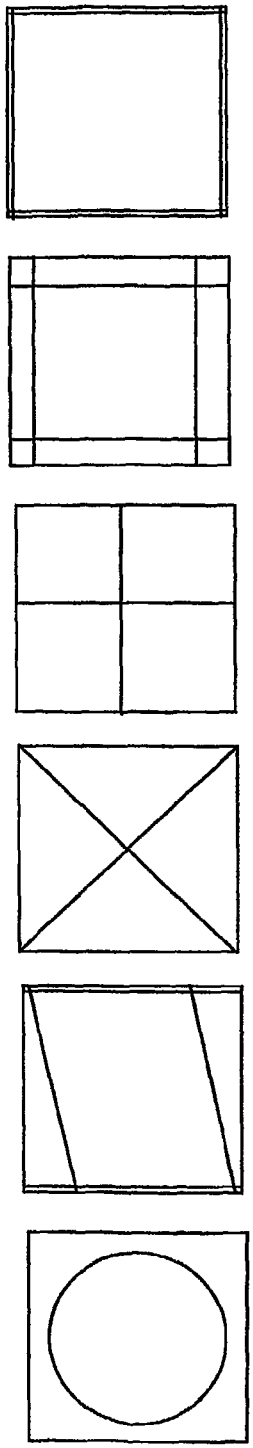

For example, as shown in FIG. 7(*a*), the cross-section of a bend or stiffening means of each panel may be substantially curved, round, square, hyperbolic, or trapezoidal in shape, to name a few. Furthermore, the spacing and angle of intersection between the wires forming the stiffening portion(s) may include, among others, those further shown in FIG. 7(*b*).

As previously mentioned, the generally planar surface 70 forming the fence panel 65 may include latitudinal or longitudinal wires 10, 15 having a variety of different gauges mixed or arranged within the respective set of wires. In this regard, in one embodiment, smaller gauge (thicker) wire preferably comprises a section/portion of the stiffening means, as thicker wires can provide greater strength than thinner wires (persons of ordinary skill in the art will understand that variations in wire type can also or alternatively be used to affect the properties of the panel at various locations thereon). FIG. 3 illustrates the preferred "thicker" wires or other elements used in conjunction with the stiffening portions of the panel. As shown, the three right-most and the three bottom-most wires are thicker than the upper and left-most wires. Persons of ordinary skill in the art will understand that, in other embodiments, the wires or other elements can be uniform or have other relative sizes.

Figure 8:
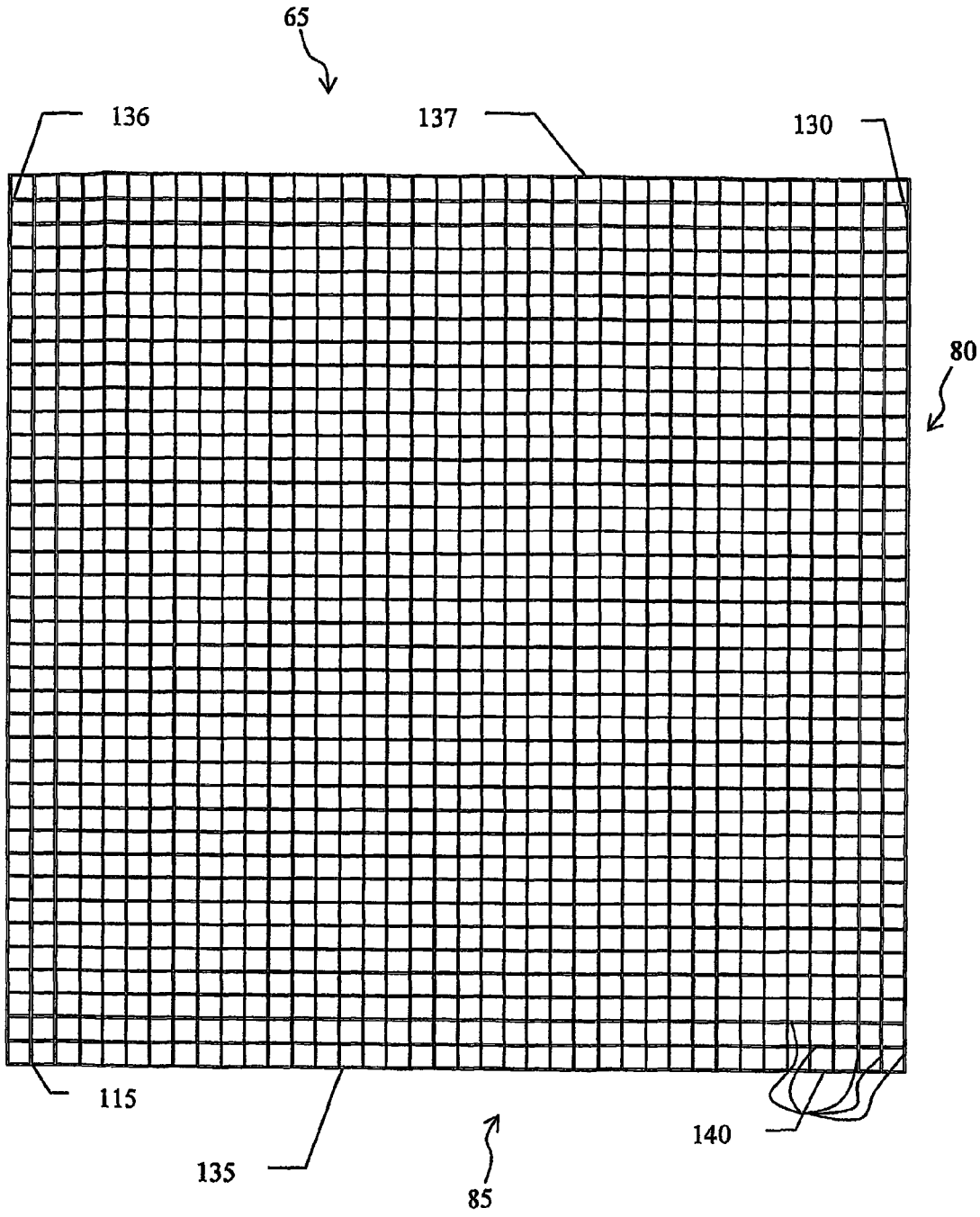
FIG. 8 shows an alternative embodiment of the invention, which includes latitudinal and/or longitudinal wire(s) of a gauge that is different from other wires within the fence panel.

As shown by the heavy/darker lines in FIG. 8 and larger diameter circles in FIG. 3(*a*) (both representing the thicker wires in FIG. 3), the thicker wire 140 preferably forms at least a portion/segment of the first bend 80 and the second bend 85 along the sides 130, 135 of the panel 65 (additional bends 136 and 137 are illustrated on the opposing edges of the panel in FIG. 8, and may be used to provide even further stiffening and other beneficial properties, although for some applications those additional bends may not be necessary or desired). In this manner, the thicker wire 140 adds further stability to the panel 65 (as compared to thinner wire).

Figure 9:
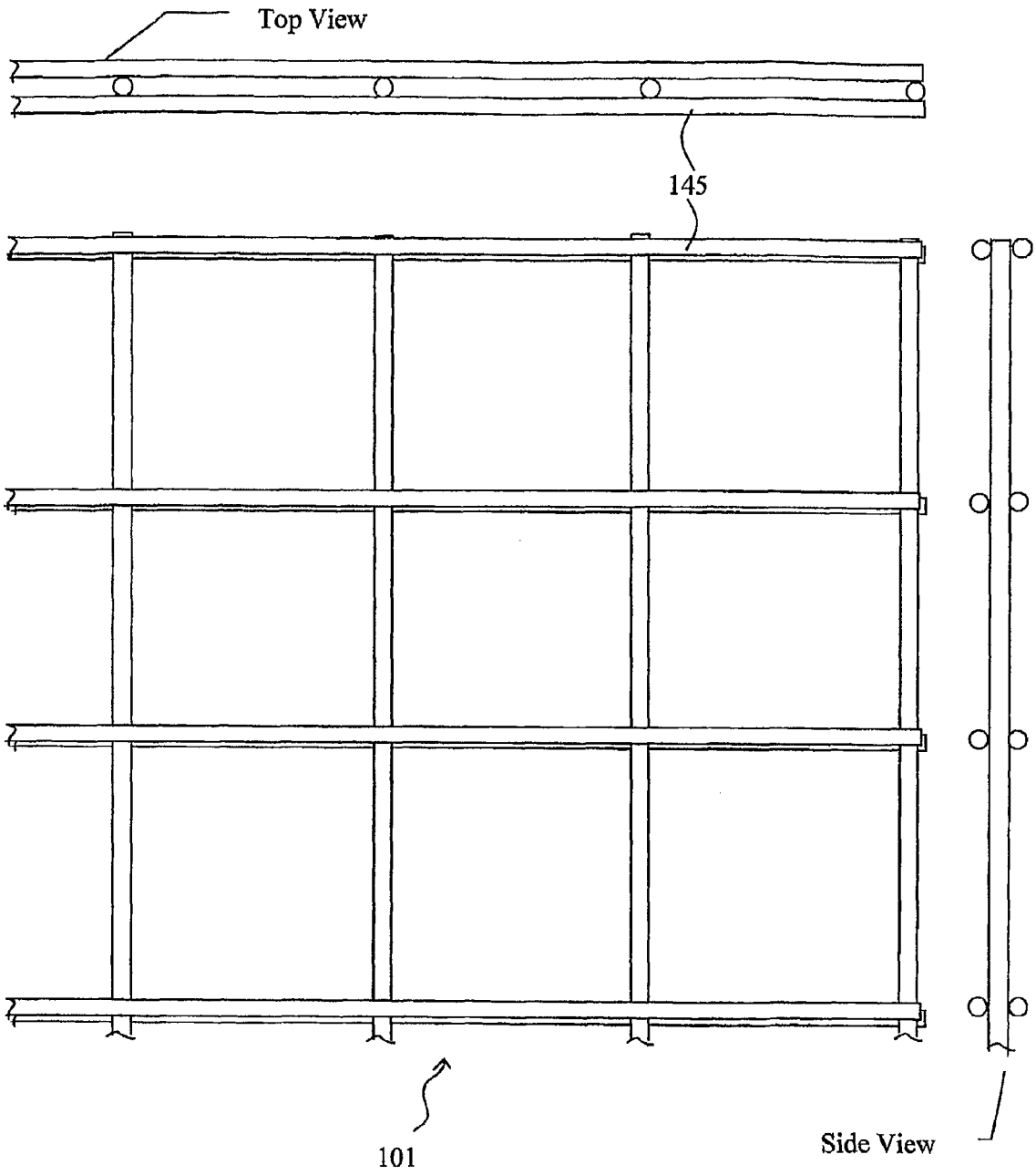
PRIOR ART FIG. 9
FIG. 9 shows a prior art fence panel with an augmented horizontal support means.
Figures 10A, 10C:
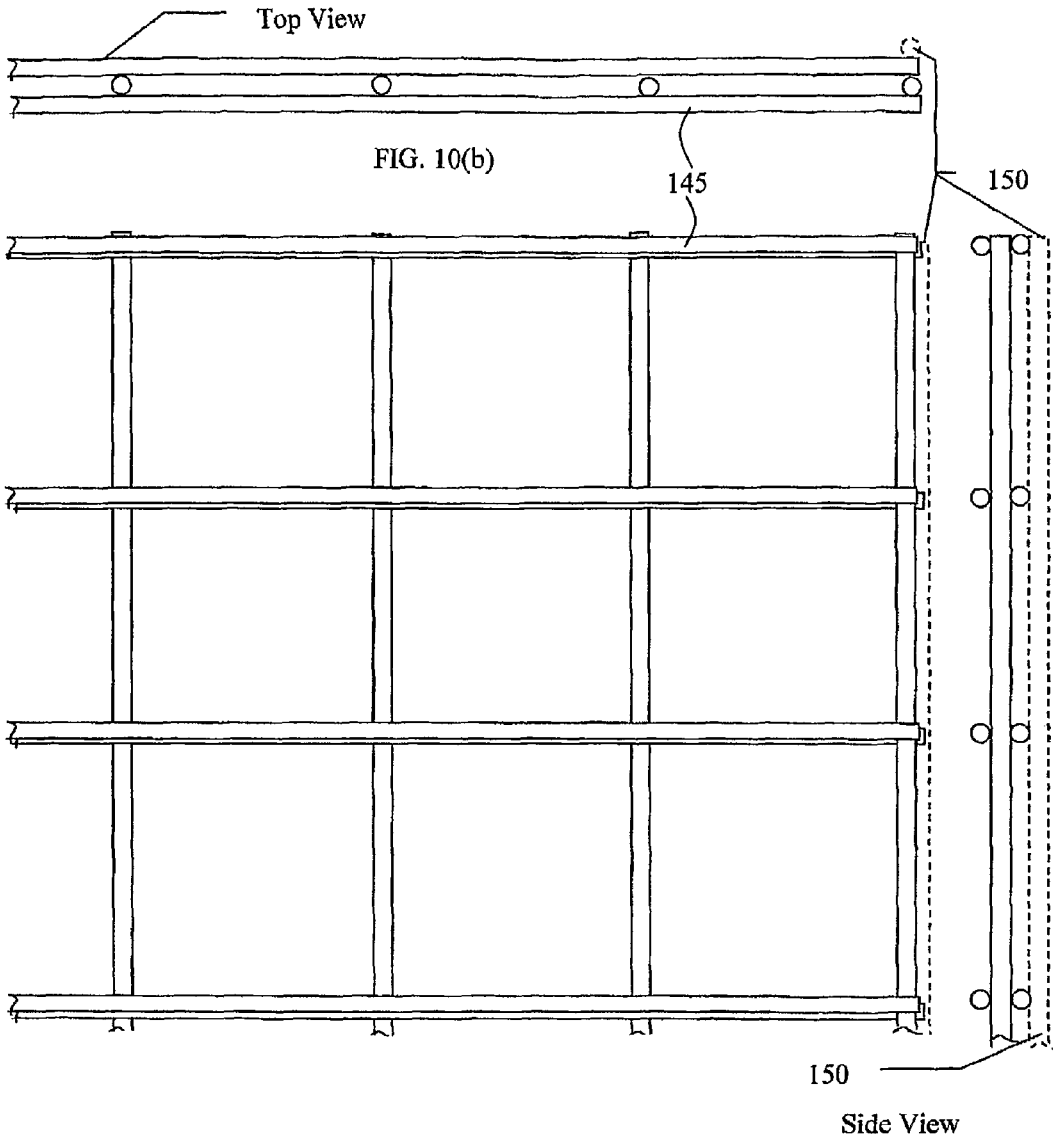
FIGS. 10(*a*)-(*c*) shows how a prior art fence panel (in solid lines) may be modified (by adding the elements shown in phantom) to constitute another embodiment of the invention, by adding a vertical wire along the general edge of the panel.
Figures 11A, 11B, 11C:
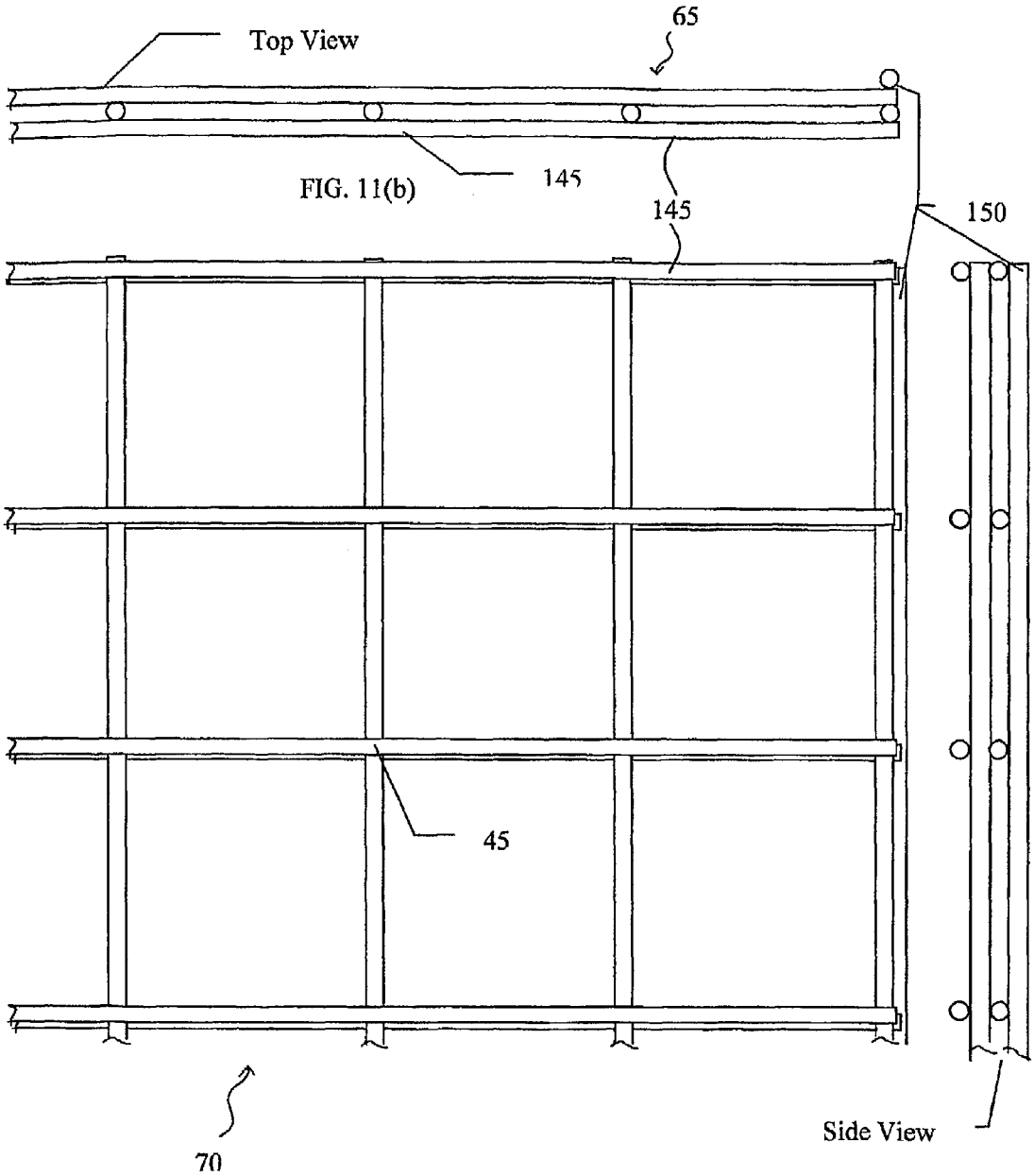
FIGS. 11(*a*)-(*c*) are similar to FIGS. 10(*a*)-(*c*), but shows the added wires in solid lines.

Alternatively or additionally, a single wire or plurality of wires may be added (beyond the normally spaced pattern of the wire mesh) to the generally planar surface 70, or a shaped material, such as iron or plastic, may be added to increase the structural stability to the panel. Depending on the application, the addition of these stiffening/support wires or other materials may reduce or eliminate the need for the intersecting "bend" stiffeners. For example, FIG. 9 shows a typical known reticulated wire fence panel 101 with an augmented horizontal support means 145. FIGS. 10(*a*)-(*c*) shows how that known panel from FIG. 9 might be modified to practice the invention, such as by adding one or more vertical wires 150 (indicated by dotted lines) outside the generally planar surface. The vertically oriented wire 150 may be used alone or in combination with the horizontal wire 145 to provide stiffening along at least the vertical plane of the fence panel. Finally, FIG. 11 shows the finished assembly that results from actually including the "additional stiffening" wires shown in phantom in FIG. 10. Thus, FIG. 11 illustrates various views of a generally planar surface 70 of a fence panel 65 having vertical and horizontal stiffening means in accordance with one embodiment of the invention.

Figure 12A:
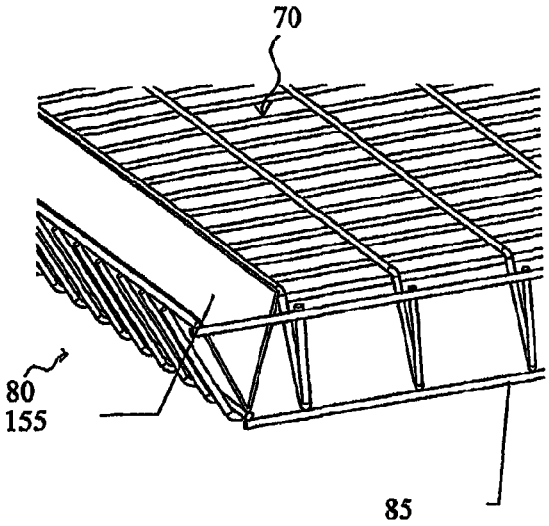
FIGS. 12(*a*)-(*b*) are a perspective view and a side view of an insert that may be used alone or in combination with other stiffening means as described herein.
Figure 12C:
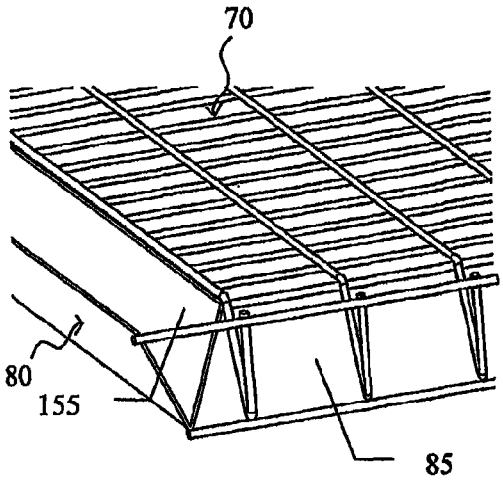
Figure 12B:
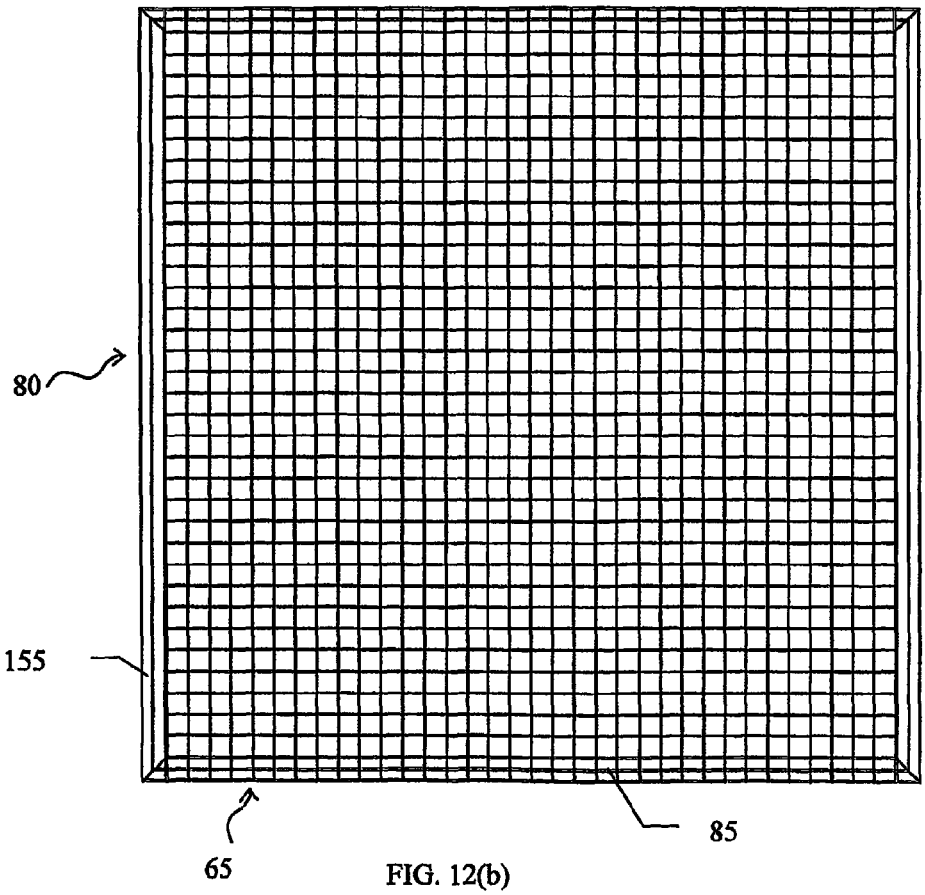

As shown in FIG. 12(*a*), a generally triangular or V-shaped insert 155 may be constructed of metal, plastic, or a similar material, and may be used alone or in combination with other stiffening means (such as those described herein) to provide rigidity in a generally vertical and/or horizontal direction along the generally planar surface 70. For example, as shown in FIG. 12(*a*), the V-shaped insert 155 is positioned in one bend 80, while a second bend 85 formed in the panel 65 has no such insert. In this example, the generally planar body 70 portion includes at least two generally linear non-parallel deformed stiffening portions 80, 85, and a V-shaped insert 155 formed, pressed, welded, or otherwise attached in the body portion 65.

FIG. 12(*b*) illustrates the concept of the stiffening portions 80, 85, 155 (generally oriented along the horizontal and vertical edge) being deformed so as to be distinct from the majority of the generally planar body portion 70. Persons of ordinary skill in the art will understand that (similar to other stiffening means, including the bends 80, 85 described herein) the shape, length, structure (perforated or solid) and attachment of the insert 155 to the generally planar surface 70 of the fence panel 65 may vary according to the panel's intended application. Among other things, inserts or supplemental elements, such as insert 155, may extend less than the full length of the fence panel, or a plurality of such insert elements may be used spaced from each other along a bend or stacked/sandwiched upon each other within a single bend, to provide a wide variety of specifically located strengthening to the panel. Such inserts can be attached to or otherwise retained in relationship to the panel in any suitable manner (via welding, gluing, interference fit, etc.). Persons of ordinary skill in the art will understand that the nature of the attachment can affect the strength and other properties of the bend/insert area of the fence panel. For example, although insert 155 is shown both as extending across substantially the entire cross-sectional "V" of deformation or bend 80 and as extending substantially the full length of the panel 65, persons of ordinary skill in the art will understand that additional or alternative stiffening members such as insert 155 can be formed in any of a wide variety of sizes, shapes, and materials, or combinations thereof, even within a single bend or deformation 80. An example of a smaller sized insert 450 is shown in FIG. 32(*a*). Such an insert 450, used to reinforce or strengthen the bend may be positioned anywhere along the first bend 80 or second bend 85.

Similarly, FIG. 12(*c*) shows a generally triangular or V-shaped section 155 used alone or in combination with other stiffening means (such as those described herein) to provide rigidity in a generally vertical and/or horizontal direction along the generally planar surface 70. For example, as shown in FIG. 12(*c*), the V-shaped section 155 is positioned and attached in place by welding or other suitable means to form one bend 80, while a second bend 85 is formed in the panel 65 by deforming the mesh, as previously described herein.

The generally triangular or V-shaped section 155 or stiffening means may be joined to form corner sections as shown in FIGS. 33(*a*) and 33(*b*). Likewise, generally triangular sections 115 may be joined to form t-style connections that may be located along an edge of the panel or inset from the edge. FIGS. 33(*d*)-(*g*) illustrate some of the many alternative embodiments of the V-shaped section each providing stiffening support for the panel.

As shown in FIGS. 33(*h*)-(*l*) each of the aforementioned V-shaped sections 155 provide for improved nestability when stacking similarly configured panels. Such V-shaped sections 155 may be joined to the spaced-apart wires 10, 15 by weaving chain link 460 through holes 455 punched in the V-shaped section 155 (FIG. 33(*h*)), welding or a similar method (FIG. 33(*i*)), a compression or friction fit by sliding the spaced apart wires 10, 15 through corresponding holes 455 in the V-shaped (FIG. 33(*j*)), by a clamping or positioning the spaced apart wires 10, 15 between mating halves of a V-shaped configuration (FIG. 33(*k*)), or by a tight-fit facilitated by the material memory of the V-shaped section that is force open to accept the spaced-apart wires 10, 15 then returns to generally its original position to secure the wires 10, 15 in place.

Alternative embodiments of the invention may include a fence panel 65 having a generally planar body portion 70 formed by means other than spaced-apart wires 10, 15. For example, the generally planar body portion 65 may be formed or cut from a single sheet of metal, plastic, or similar malleable material (not shown). The single piece body portion may include at least two non-parallel stiffening portions or bends hammered, pounded, pressed, molded, or otherwise deformed into the body 65.

Figure 13:
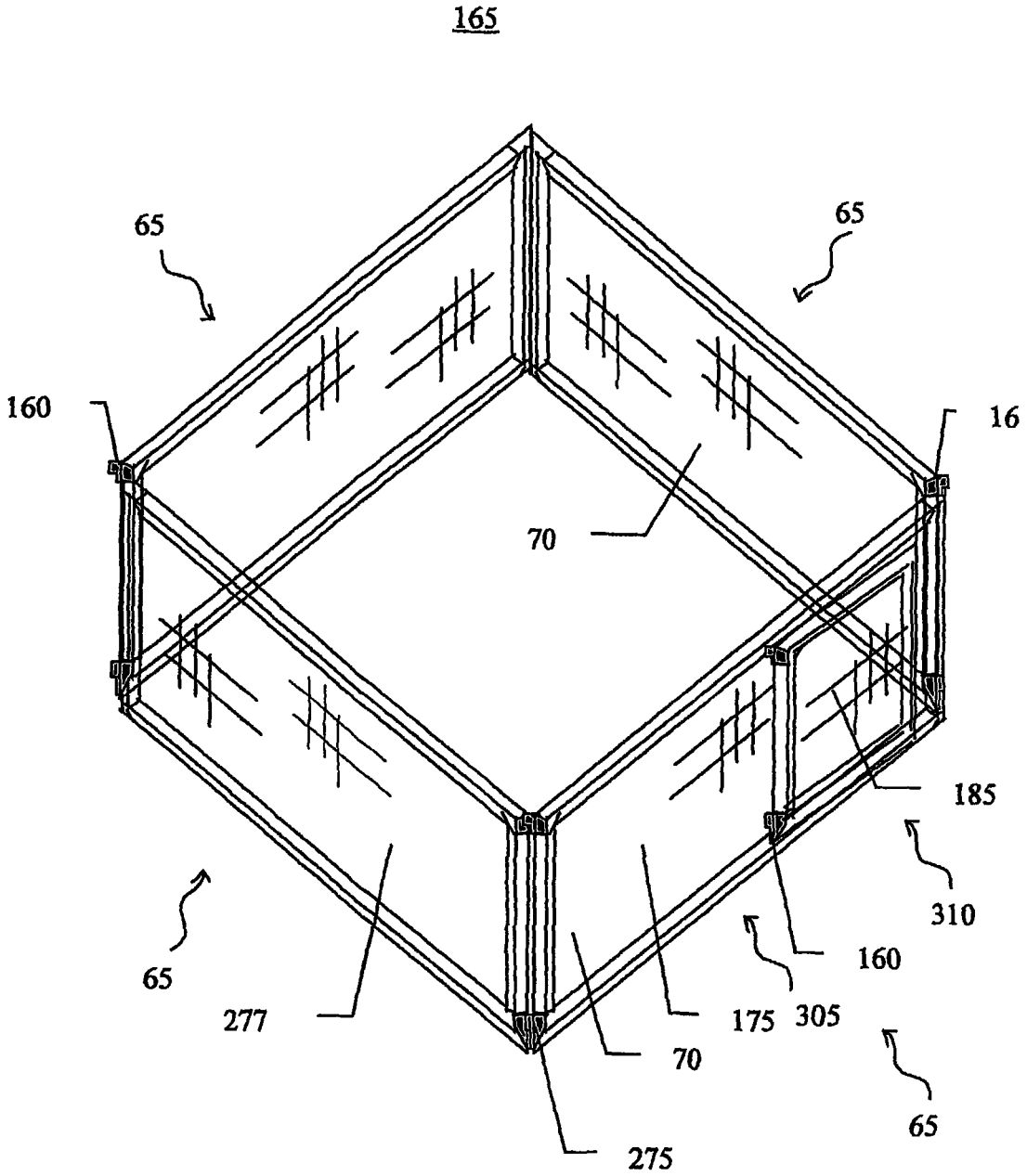
FIG. 13 is a perspective view of an enclosure constructed of various fence panels, each formed from spaced-apart wires, and having at least two non-parallel stiffening means deforming the fence panel from the panel's generally planar configuration.

As shown in FIG. 13, fence panels embodying the invention may be manufactured of various lengths and/or widths and/or configurations, and may be joined together to form various fence patterns or enclosures, or other related elements and structures. Persons of ordinary skill in the art will understand that the size and configuration of the fence elements, as well as the assembly of panels/elements together, can be any of a virtually infinite variety. For example, the panels 65 forming a sidewall or gate/door may be hinged or otherwise joined together by a joining device 160 to form an enclosure 165; boarding or containment structure such as a cage, pen, or kennel; or as a boundary element in a yard, playground, or prison, to name a few. Persons of ordinary skill in the art will understand that any single side or all the sides of a structure may contain embodiments or features of the invention, as described herein (thus, fence portions incorporating the invention may be combined with other fence-type elements, or attached to independent buildings/walls/etc.). For example, a cage may have at least one side formed at least in part from a panel of the invention. Alternatively, the cage may include a plurality of sides formed from panels incorporating the invention.

FIG. 21 illustrates one of the many ways that various aspects of the invention can be incorporated into more complex assemblies and structures. In FIG. 21, a panel 185 may be configured as a door or gate 310, and is pivotably mounted and retained within a larger panel 175. Some of the preferred details of this exemplary structure are shown in other drawings. Persons of ordinary skill in the art will understand, however, that panels incorporating the invention might be used for only one part of such an assembly (e.g., only the gate/door or only the surrounding panel), while conventional or other technologies might be used for the other components of the assembly.

Figure 14:
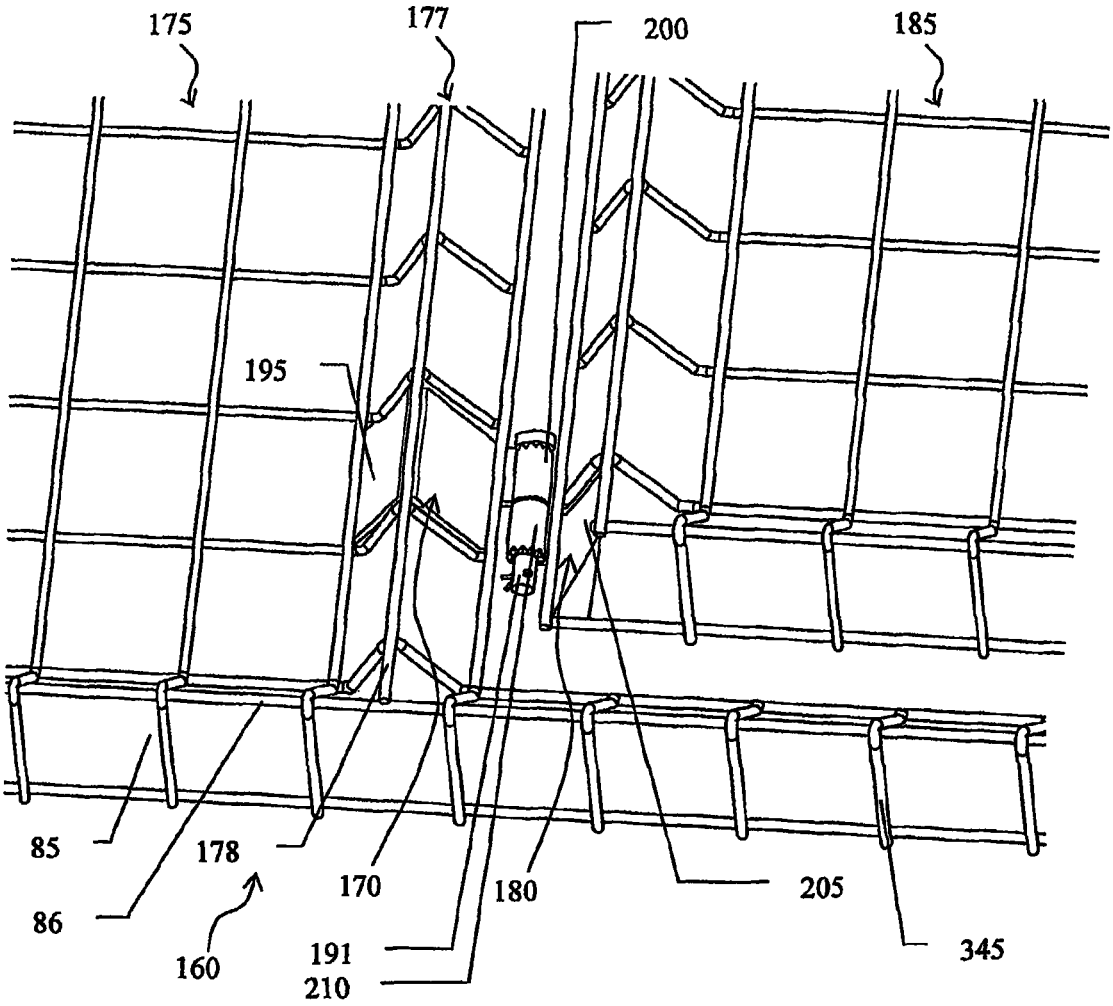
FIG. 14 is an enlarged perspective view taken along line 14 in FIG. 21, and illustrates a joining device in accordance with one embodiment of the present invention.

For example, FIG. 14 illustrates one of the many types of joining devices for joining a generally planar panel to another thing (such as a wall, a post, or another panel). In one embodiment, the joining device 160 includes a first component 170 for engaging a first fence panel 175, as described herein, and a second component 180 for joining a second fence panel 185, as described herein. Preferably the first and the second components 170, 180 each include a housing 200, 210 that is joined together pivotably by a connecting device 191 or alternatively the connecting device 190 shown in FIG. 15(*a*). Alternatively, and as indicated above, persons of ordinary skill in the art will understand that the joining device 160 may be connected to a first panel having features of the invention described herein and a second panel of known construction, or a wall or other thing, as noted above.

Although the joining of a fence panel to another thing is described herein with reference to specific drawings, persons of ordinary skill in the art will understand that certain aspects of the invention can be practiced with a wide variety of connecting or joining devices, and that those devices can position the panel in a "fixed" relationship with the thing or in a "dynamic" relationship (permitting movement such as hinged rotation or otherwise of the panel with respect to the thing). Any suitable method and apparatus for joining or connecting can be used, and the specific apparatus and method used in any given application may be affixed to the panel in any suitable manner as well (for example, by welding, gluing, screwing, clamping, integrally forming the joining piece with the panel, etc.).

As will be apparent from the further drawings and the following description (showing, for example, the preferably easy switch between engaging toothed ends of the components 200, 210 for a fixed engagement, as compared with smooth ends for a rotatable engagement), the preferred joining device 160 in the example of FIG. 14 provides great flexibility of use in a variety of applications. Among other things, the same components may be selected between either (a) hinged/moving attachment of the panel or (b) a fixed attachment. Persons of ordinary skill in the art will understand that alternative joining/connecting devices can vary greatly, especially if they are not intended to provide the same degree of flexibility of use as the one shown in FIG. 14.

For ease of describing the joining device 160 in the example of FIG. 14, it will be understood that except for differences specifically described herein, the description of the invention as applied to the first component 170 (such as having a first engagement surface corresponding to at least a portion of the cross-sectional shape of one of the first bend and the second bend) generally also applies to the second component 180.

The first component 170 of the joining device 160 preferably includes a first engagement element, such as surface 195, for engaging the first panel 175, and a first housing 200 connected to the first engagement surface 195 and adapted to receive the connecting device 191. Similarly, the second component 180 may include a second engagement element, such as surface 205, for engaging the second panel 185, and a second housing 210 connected to the second engagement surface 205 and adapted to receive the connecting device 191. In one embodiment, the connecting device 191 (typically a bolt, screw, rod, hinge pin, or similarly adapted structure) is received within the first housing 200 and the second housing 210 to attach the first housing 200 to the second housing 210, thereby attaching the first panel 175 to the second panel 185.

For most or all embodiments, including especially those in which the fence panel's stiffening elements are not at the panel edges or are provided in some manner other than bending the panel, the location on the panel at which the joining/connecting member is affixed and the means for that affixing can vary widely. For many embodiments (including even panel embodiments that include stiffening bends at the edges of the panels), a plurality of joining/connecting members can be used and their spacing/positioning along the edge or otherwise on the panel can vary widely, depending on the demands of the application. For example, panels of the invention can be used as a gate/door, a frame for the door/gate, or both, and joining devices can be provided that function similarly to hinges on a door. Joining devices could extend into and be clamped to the central web or mesh of the panel, with a "hinge" portion extending outwardly toward the point of connection with the adjacent panel or thing.

As mentioned above, in the example shown in FIG. 21 and FIGS. 14-20, two panels of the invention are joined in a gate/frame relationship. The first panel 175 forms the frame (which is just one example of the many shapes in which the panels of the invention can be provided). In FIG. 21, that frame panel 175 includes a perimeter of strengthening bends as previously described, but also includes an opening 176 formed within the body of the panel. In FIG. 21, the opening 176 preferably is completely bordered by strengthening bends, for strength and other purposes, such as described herein. To form the central strengthening bend 177, wire 178 (FIG. 14) preferably is cut to, or otherwise provided in, an appropriate length to reach a corresponding transverse wire 86 in bend 85, to permit welding or other attachment of those two wires at that location. The other end of wire 178 preferably is similarly configured and assembled to the top stiffening bend 179 (FIG. 21) in panel 175.

Figure 23:
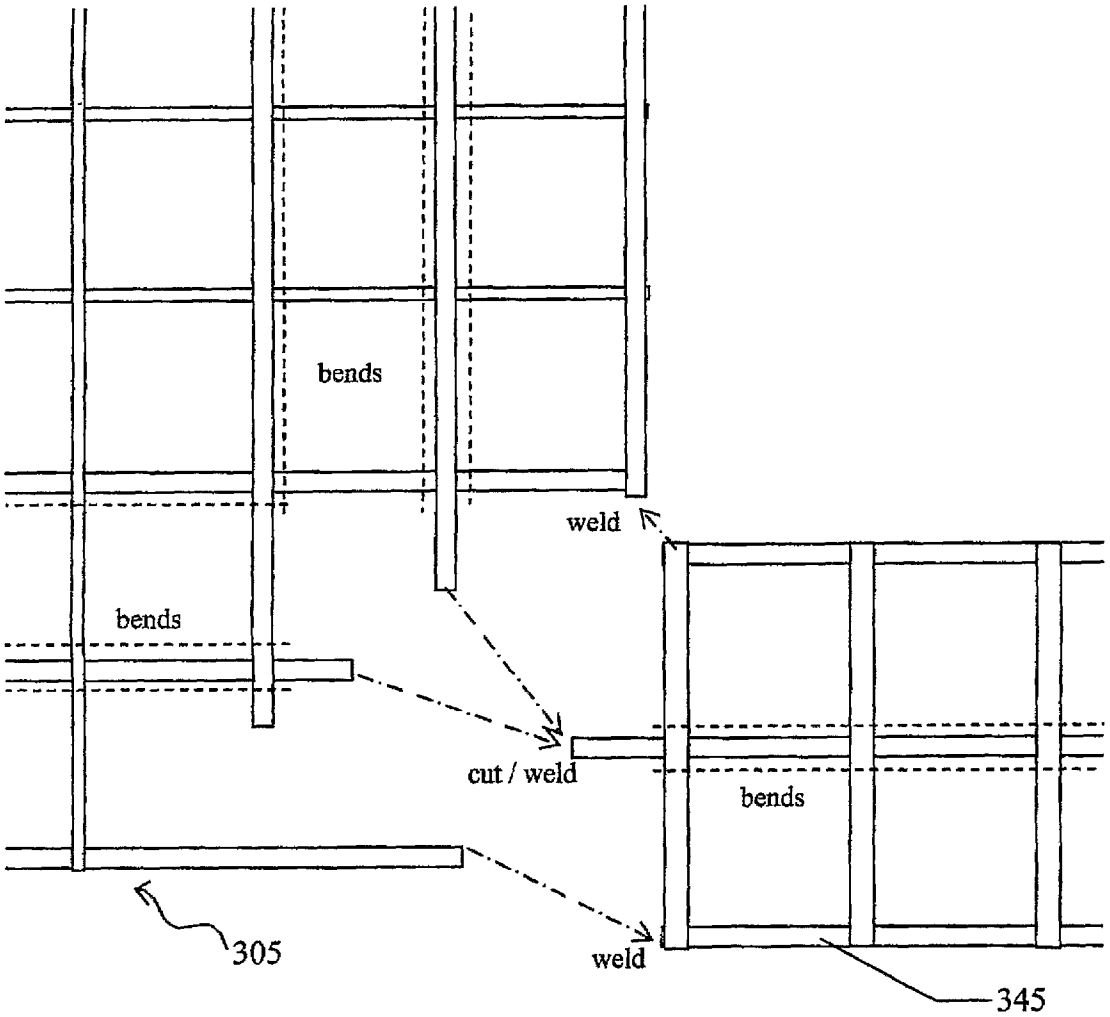
FIG. 23 shows preferred cuts in a fence panel having a generally planar surface to form a riser in accordance with one embodiment of the present invention.

A preferred method of fabricating such a joint/junction is shown in FIG. 23 and discussed below, and illustrates one of the many ways to make the preferred cuts, weld, and bend points on a fence panel 65 for the embodiment of a riser 345, such as that shown in FIGS. 14 and 21. Among the alternatives to that approach, the frame around the door/gate 310 may be integrally formed with the rest of the sidewall 305. Among other things, this would impact the spacing of the various transverse wires in the frame around the door 310.

Persons of ordinary skill in the art will understand that, depending on the application, one or more openings, such as opening 176, may be provided within a panel, may or may not be "bordered" with strengthening bends, and may or may not be "filled" with any object, such as a panel/gate/door.

In FIG. 14, the first engagement surface 195 can be engaged with the panel 175 in any suitable manner, but is preferably shaped to correspond to the shape of at least a portion of the bend 177 of the first panel 175.

Figures 15, 15A:
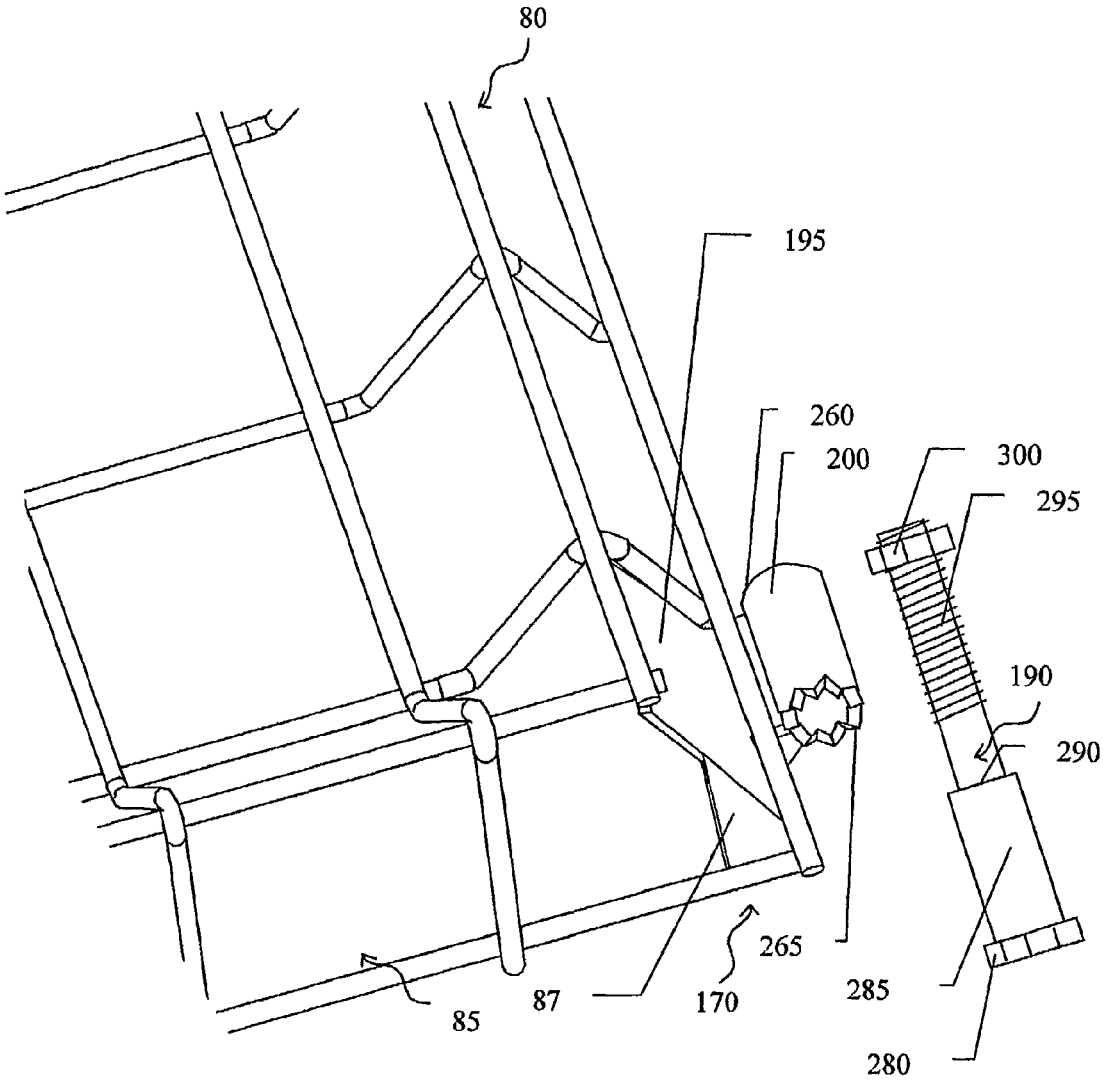
FIG. 15 is an enlarged perspective view taken along line 15 in FIG. 21, and shows an alternative embodiment of a joining device, positioned at a junction of the fence panel.

Persons of ordinary skill in the art will understand that similar or identical devices can be positioned at a wide variety of locations on panels, such as panel 175, including on or near the first bend 80 and the second bend 85, to facilitate pivotal or other junctions between panels or other components. An example of the many varieties of such engagements can be seen by comparing FIGS. 14 and 15. In FIG. 14, the first engagement surface 195 is configured to correspond in shape and size to a portion of the side of the central bend 177. This approach might be useful, for example, for bend shapes that are substantially triangular in cross-section (to mount the engagement elements in such an area, the first engagement surface 195 would preferably have a corresponding substantially triangular cross-sectional shape). However, as shown in FIG. 15, if the first engagement surface 195 is attached at the junction 115 of a bend 80 and the second bend 85, the first engagement surface 195 would preferably have a shape somewhat different from substantially triangular in cross-section (such as a somewhat trapezoidal shape, with possibly a "return" arm 87 to provide additional support and strength to the assembly and/or engagement area/elements). In contrast or in addition to the joining device being positioned near the bottom of a fence panel (as shown in FIG. 15), the joining device 160 may be adapted to be positioned generally at the top of the fence panel (as shown in FIG. 16) or anywhere along the fence panel as required by a particular application.

The first engagement component 170 is preferably attached to the first bend 80 or the second bend 85 by welding. Other attachment means, such as clamping, bonding, press fitting, or the like may be utilized. In one embodiment, shown in FIG. 2, permanent attachment of the first component 170 to the fence panel 65 still allows for nesting during shipping or moving of the invention, as described herein (the preferred engagement elements 200 are shown in phantom in FIG. 2, as certain embodiments of the invention may be fabricated without such joining or engagement elements).

The preferred joining device 160 of the present invention generally functions to join fence panels 65 in a freestanding installation (not attached to the ground) while the stiffening portions provide stability. Furthermore, when joining device 160 joins panels 65 in a fixed or non-rotational connection, a synergistic stabilizing affect is achieved between adjacent panels.

Figure 17:
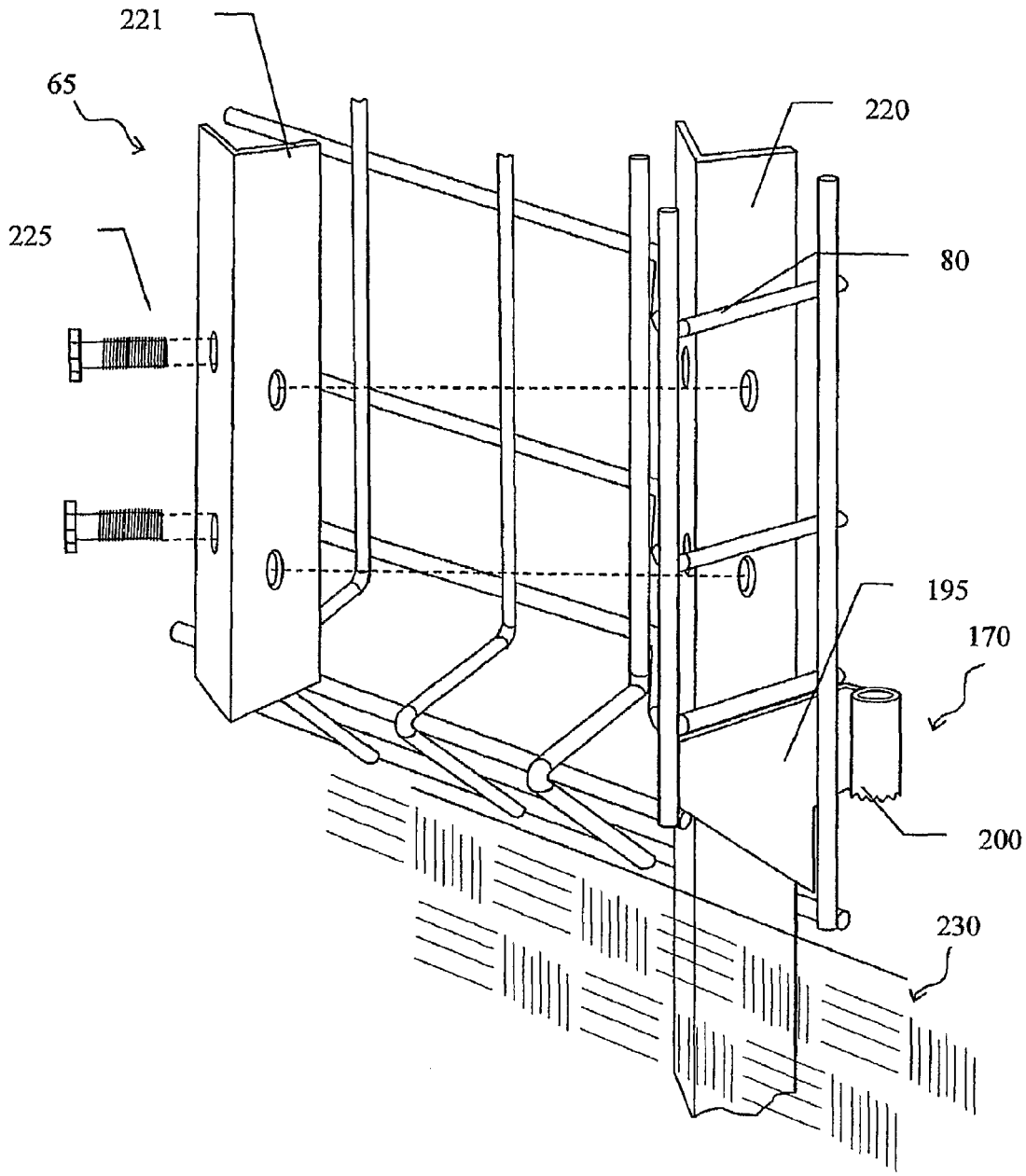
FIG. 17 shows an insert for removable attachment of an anchoring device to a fence panel.

As noted above, the engagement elements may be attached to the panels in any suitable manner, including removable, permanent, etc. One such "removable/temporary" example is shown in FIG. 17, made of metal, plastic or similar material and may be removably attached to the fence panel 65 by inserting it into the stiffening bend 80. The insert 220 may be shaped to correspond to the cross-sectional shape of one of the fence panel bends and, together with similarly shaped clamping section 221 and connecting means 225, such as a nut, bolt, screw, bracket, pin, etc., connect the insert 220 to the fence panel 65 and/or bend. The insert 220 also may extend upwardly (as shown) or in another direction (for embodiments not shown, such as horizontally-oriented inserts 220) from the panel 65 to connect the fence panel 65 to another panel (not shown), another element of the invention, as described herein, and/or to the ground or other relatively secure surface 230, such as a wall, floor, or support base. For engagement with the ground (such as indicated in FIG. 17 by the gray stake extending into the material below the panel), the insert 220 can be driven or otherwise inserted into the ground, and the panel assembled to the resulting "stake".

Figure 18:
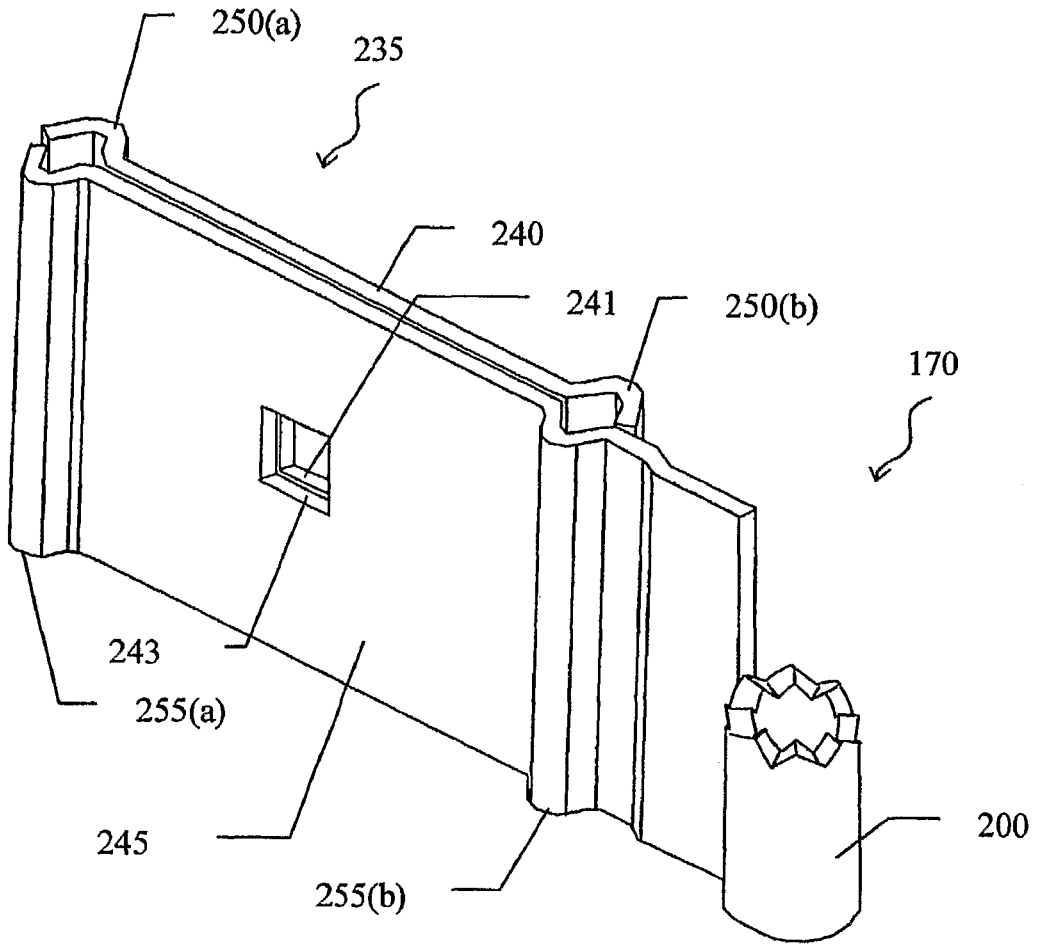
FIG. 18 illustrates another of the many embodiments of a joining device in accordance with the present invention.

FIG. 18 shows another of the many alternative ways to attach engagement/joining elements to panels of the invention, showing how the first component 170 may be removably or permanently attached to a fence panel, such as panel 65. The preferably two-piece apparatus 235, similar in many ways to a preferred latch assembly embodiment described below, includes a first section 240 and a second section 245. Each section 240, 245 preferably has appropriately spaced grooves 250(*a*)-(*b*), 255(*a*)-(*b*) to receive correspondingly spaced wires of the fence panel 65. The sections 240 and 245 may be permanently mounted in engagement with the panel wires (such as by welding or other affixation to each other or to the wires), or may be temporarily, removably assembled on the wires. By way of an example of the latter, a connecting member (not shown, but preferably similar to the connection device 340 in FIG. 22), such as a bolt, rivet, or similar device, can be assembled through the holes 241, 243 through the sections 240, 245, thereby preferably connecting the first section 240 and the second section 245 together around the panel wires and thereby securing the first component 170 to a portion of the fence panel 65. As another method of more permanent affixation, the sections 240, 245 could be joined by a rivet through the holes 241, 243.

Although simpler engagement/joining elements can be utilized within the invention, additional flexibility can be provided with preferred engagement/joining structures and methods. For example, returning now to FIGS. 14 and 15, the first housing 200 of the first component 170 and the second housing 210 of the second component 180 are each preferably tubular in shape and each preferably have a substantially smooth end 260, and a toothed/ridged end 265 opposite the smooth end 260. By assembling the engagement/joining elements in an orientation so that adjacent toothed/ridged ends 265 engage each other and are bolted together with bolt 190 (FIG. 15(*a*)), the joined panels will not rotate with respect to each other—instead, the teeth on the opposing panel's joining elements prevent turning or rotation of the housings with respect to each other, around the bolt 190. To provide rotation, all that is required is that the joining elements be positioned so that their opposites ends (smooth ends 260) abut each other when bolted together with the bolt 190. Assuming that the bolt 190 and nut 300 are not assembled too tightly or alternatively by using a joining device such as hinge pin 191, the smooth surfaces 260 preferably permit desired rotation of the panels or other elements with respect to each other.

In other words, selective attachment of the first housing 200 to the second housing 210 so that their respective smooth ends 260 abut each other preferably provides rotational attachment of the first panel 175 with respect to the second panel 185. Alternatively, selective attachment of the first housing 200 to the second housing 210 so that their respective ridged ends 265 abut each other preferably provides non-rotatable attachment of the first panel 175 to the second panel 185.

As used herein, "smooth ends" is a broad term used to denote two corresponding surfaces capable of being connected together to provide selective rotatable attachment of the first panel 175 to the second panel 185 and not necessarily a physical characteristic of the surfaces. For example, persons of ordinary skill in the art will understand that such smooth ends may include relatively unfinished, roughened, or textured metal-to-metal contact. Furthermore, such rotatable attachment may be accomplished by ball bearings positioned within recesses of corresponding surfaces, or lubricated surfaces in a slidable relationship to each other.

Likewise, the selective non-rotatable attachment of the first panel 175 to the second panel 185 may be accomplished by means other than the respective toothed/ridged ends shown in the drawings. For example, a cotter pin (not shown) may be inserted into one of a plurality of holes provided in one or more of the housings.

As shown in FIG. 13, rotatable attachment between components of the joining device 160 may be used to join a fence panel 305 (sidewall) to a gate or door 310 in a hinge-like fashion. In this regard, the joining device 160 acting as a hinge provides a rotatable relationship between at least two adjacent panels 305 and 310. Depending on design considerations, the gate or door 310 may include stiffening portions/features as described herein, or the door may include a pipe frame similar to those used in known fence systems. FIG. 21 illustrates another preferably hinged engagement.

On the other hand, non-rotatable attachment between components of the joining device 160 may be used to join adjacent fence panels in a substantially fixed position relative to each other. For example, as also shown in FIG. 13, each fence panel of the enclosure (such as panel 305) may be fixedly attached such as by corner assemblies 275 to an adjacent fence panel 277 in a non-rotatable relationship. Thus, among the wide variety of assemblies that can be made using the invention, the same preferred engagement/joining elements can be readily oriented within the assembly in a variety of ways to permit a user to selectively assemble at least one of the panels (such as sidewall 305) non-rotatably to at least one adjacent sidewall 277, and also rotatably attach that sidewall 305 to a gate or door 310 within the panel. Persons of ordinary skill in the art will understand that, for other embodiments, it may be more useful to have one or more hinged engagements at the corners of an assembly such as shown in FIG. 13, and "fix" or "lock" the engagement between the gate 310 and the panel 305, or use some other mix of those various engagements.

Figure 19:
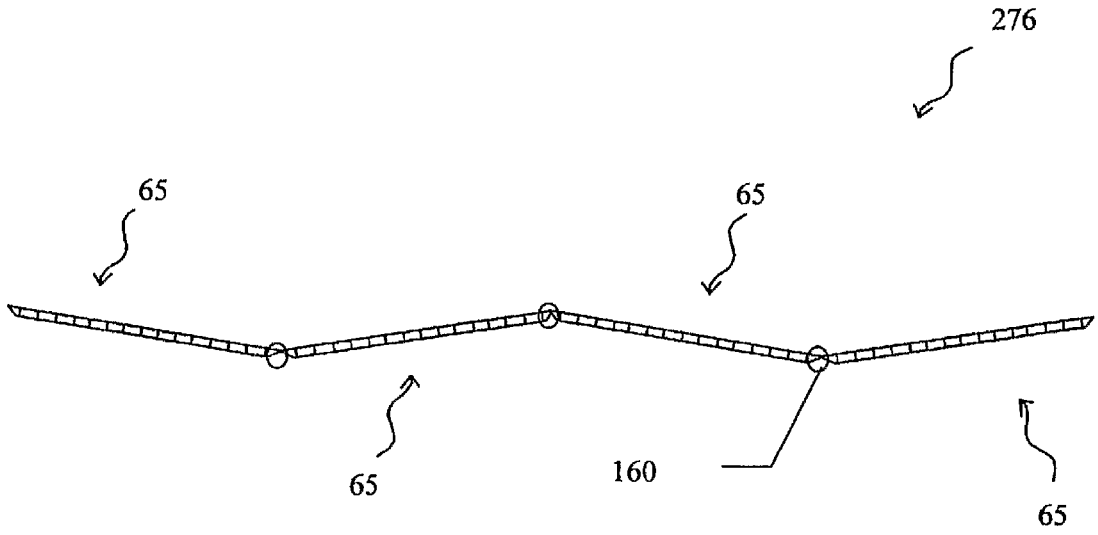
FIG. 19 illustrates one of the many possible arrangements of multiple fence panels in accordance with the present invention.

The joining device 160 also preferably further permits at least two adjacent fence panels 65 to be affixed to each other in a wide variety of selected patterns. For example, as shown in FIG. 19, a plurality of fence panels are affixed in a serpentine pattern 276 (persons of ordinary skill in the art will understand that as few as two panels could be used to form such a pattern). Depending on the application, a serpentine or similar pattern, such as shown in FIG. 19, may need little, if any, auxiliary support (such as posts, anchors, or the like into the ground or a support base), but instead may be sufficiently sturdy to remain upright and erected by using the joining device 160 to fixedly secure the fence panels together.

Figure 20:
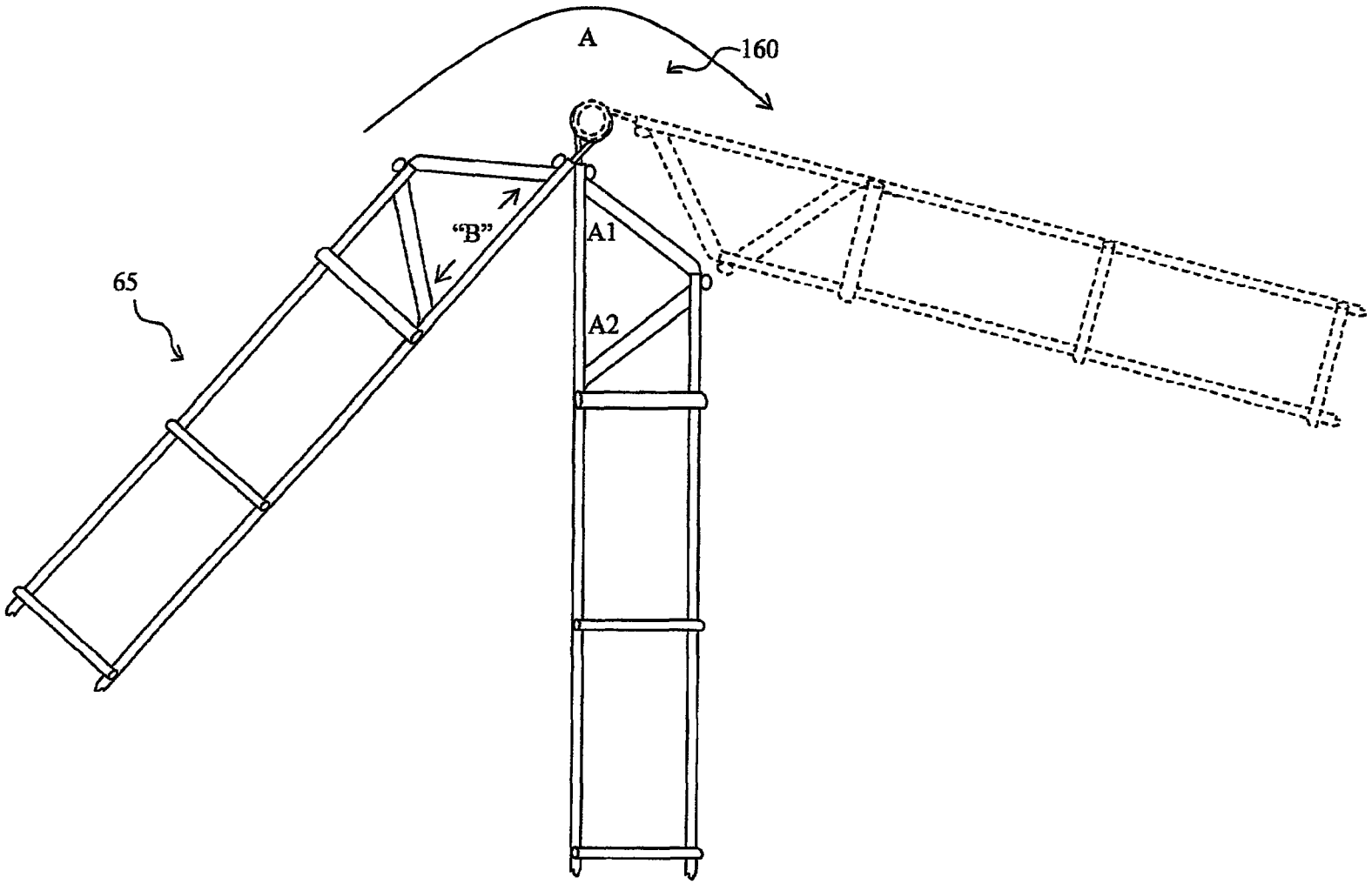
FIG. 20 illustrates the range of motion of a fence panel according to one embodiment of the present invention.

Some parameters for the patterns that may be selected using the preferred embodiment of the invention are shown in FIG. 20, in which one embodiment having a particular distance between sides of a bend defined by a distance "B" and angles A1 and A2, adjacent panels connected by a joining device/member 160 are capable of being rotated and affixed to each other in an angled relationship anywhere along arc "A". Accordingly, persons of ordinary skill in the art will understand that adjacent fence panels may be connected such that the panels are positioned at angles greater than or less than those shown in FIGS. 19 and 20 by varying one or more of the aforementioned dimensions "B" and angles A1 and A2 to form a variety of patterns.

Returning once again to FIG. 15(*a*), in one embodiment, the connecting device 190 preferably includes a head 280, a body 285 extending from the head 280 and terminating a predetermined distance from the head 280 to form a shoulder 290 to support the first housing 200 or the second housing 210, a threaded shaft 295 extending from the shoulder 290 capable of passing through the first housing 200 and the second housing 210, and a correspondingly threaded nut 300 for removable attachment to the threaded shaft 295 to secure the first housing 200 to the second housing 210.

In certain embodiments of the invention, the connecting device 190 permits one or more panels 65 to be elevated relative to the ground at least the distance from the head 280 to the shoulder 290 when the connecting device 190 passes up through the first housing 200 and the second housing 210 (thus, the bolt 190 can serve as a "post" on which the assembled panels rest, with the head 280 oriented downwardly to contact the ground, floor, or other surface). Alternatively, with the head 280 oriented upwardly (toward the top of the panels), the connecting device 190 permits positioning of one or more panels 65 on the ground when the connecting device 190 passes down through the first housing 200 and the second housing 210.

FIG. 21 shows a generally planar fence section 65 similar in many respects to sidewall 175, 185 of FIG. 13. The fence of FIG. 21 preferably is formed by spaced-apart wires 10, 15 and has at least two non-parallel bends 80, 85 deforming the fence section from the generally planar surface 70. Two panels of the invention preferably are connected by joining devices to form at least a sidewall 305 having a gate or door 310 formed therein. In this regard, FIG. 21 illustrates the preferred placement of the joining device of FIG. 15 for connecting adjacent fence panels in a non-rotating relationship. In addition, FIG. 21 illustrates the preferred placement of the joining device of FIG. 14, for connecting adjacent fence panels in a rotating hinge-like relationship of the type typically used to connect a sidewall 305 to a gate or door 310.

Figure 22:
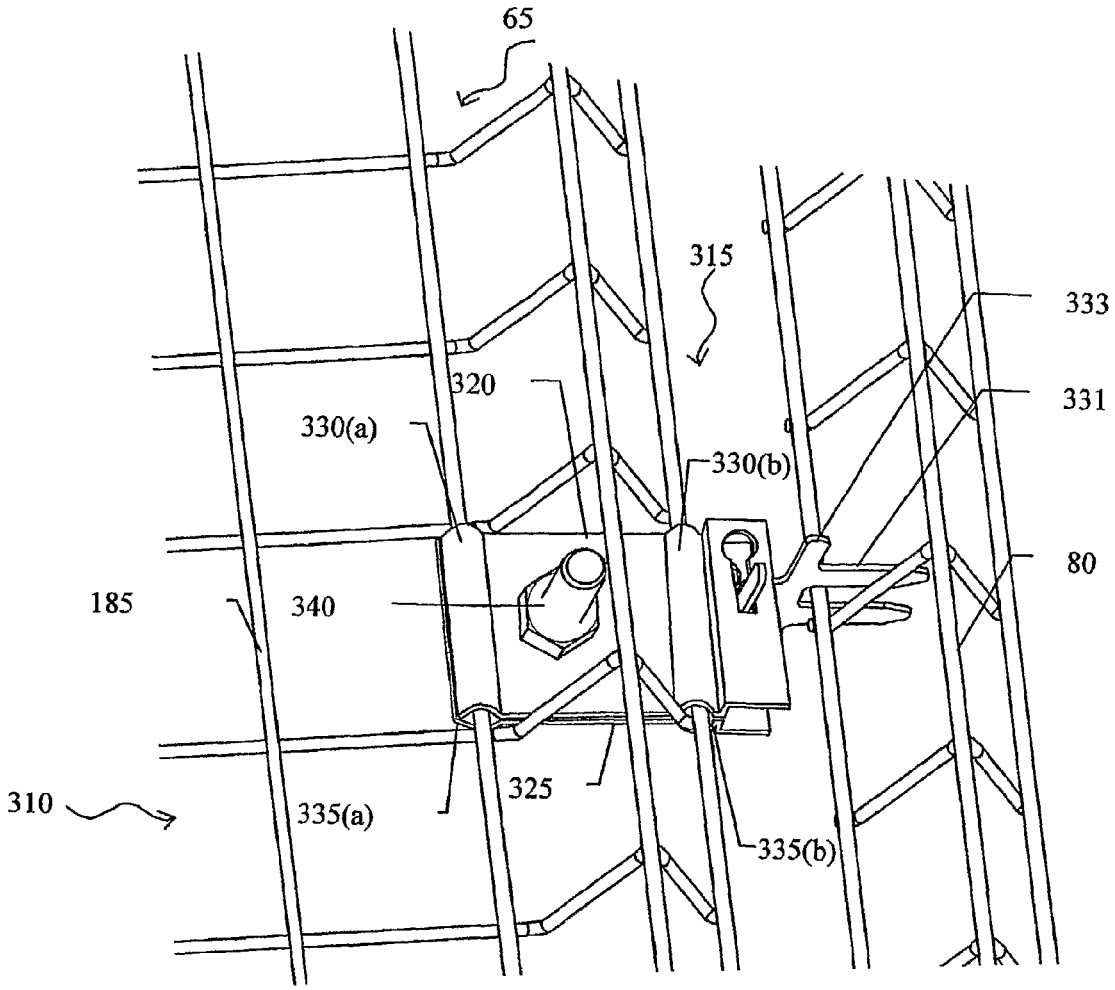
FIG. 22 is an enlarged perspective view taken along line 22 in FIG. 21, and shows one of the many latch assemblies that can be used in accordance with the present invention.

Furthermore, FIG. 21 illustrates one embodiment of a latch assembly 315, shown in greater detail in FIG. 22, that may be used to secure the gate or door 310 to the sidewall 305 in a closed position. As shown in FIG. 22, the latch assembly 315 preferably includes a first section 320 and a second section 325 (although, like the various engagement/panel connectors discussed above, it could take any suitable form and be connected to the panel in any suitable manner). In the embodiment of FIG. 22, each section 320, 325 preferably has appropriately spaced grooves 330(*a*)-(*b*), 335(*a*)-(*b*) (similar to the connector of FIG. 18) to receive correspondingly spaced wires of the fence panel 65. A connection device 340, such as a bolt, rivet, or similar device, preferably connects the first section 320 to the second section 325, thereby securing the latch 315 to the fence panel 65. Any suitable engagement latch (such as a latch having tines 331 and a gripping portion 333) can be retained within the latch assembly and operated to selectively (a) hold the door/gate in alignment (closed) with the surrounding frame or (b) allow it to swing freely. The gripping portion 333 may be lifted up and rotated back to allow the tines 331 to disengage from the stiffening bend 80.

The versatility of the preferred embodiments of the invention's fence panels and joining device(s) permit formation of a wide variety of structural formations. In one example, as indicated above, the fence panels may be joined to adjacent panels in a serpentine pattern 276. Alternatively, a gate or door 310 may be formed and rotatably attached to a fence panel sidewall 305, as shown in FIGS. 14 and 21. The gate or door 310 may be elevated or spaced upwardly within the opening 176 by an appropriate structural arrangement of the joining devices 160 relative to the first housing 200 and the second housing 210. On the other hand, the gate or door 310 may be elevated by any other suitable means, including (by way of example and not by way of limitation) the addition of a riser 345, as will now be described. For embodiments without any such riser/spacer 345, the door or gate normally just needs to be "elevated" enough to provide clearance from the ground (or floor or other underlying surface) to permit desired swinging or rotation of the gate/door with respect to the adjacent panel(s). Persons of ordinary skill in the art will understand that pet doors or the like may also be hinged along the top side of a panel, rather than from the side, as shown in the various figures herein.

FIG. 23 shows the preferred cuts, weld, and bend points on a fence panel 65 for the embodiment of a riser 345, such as that shown in FIG. 14. As in other figures described above, preferred bend locations are shown by dashed lines. Alternative riser embodiments and joining device connectivity is shown in FIGS. 24-25.

Figure 24:
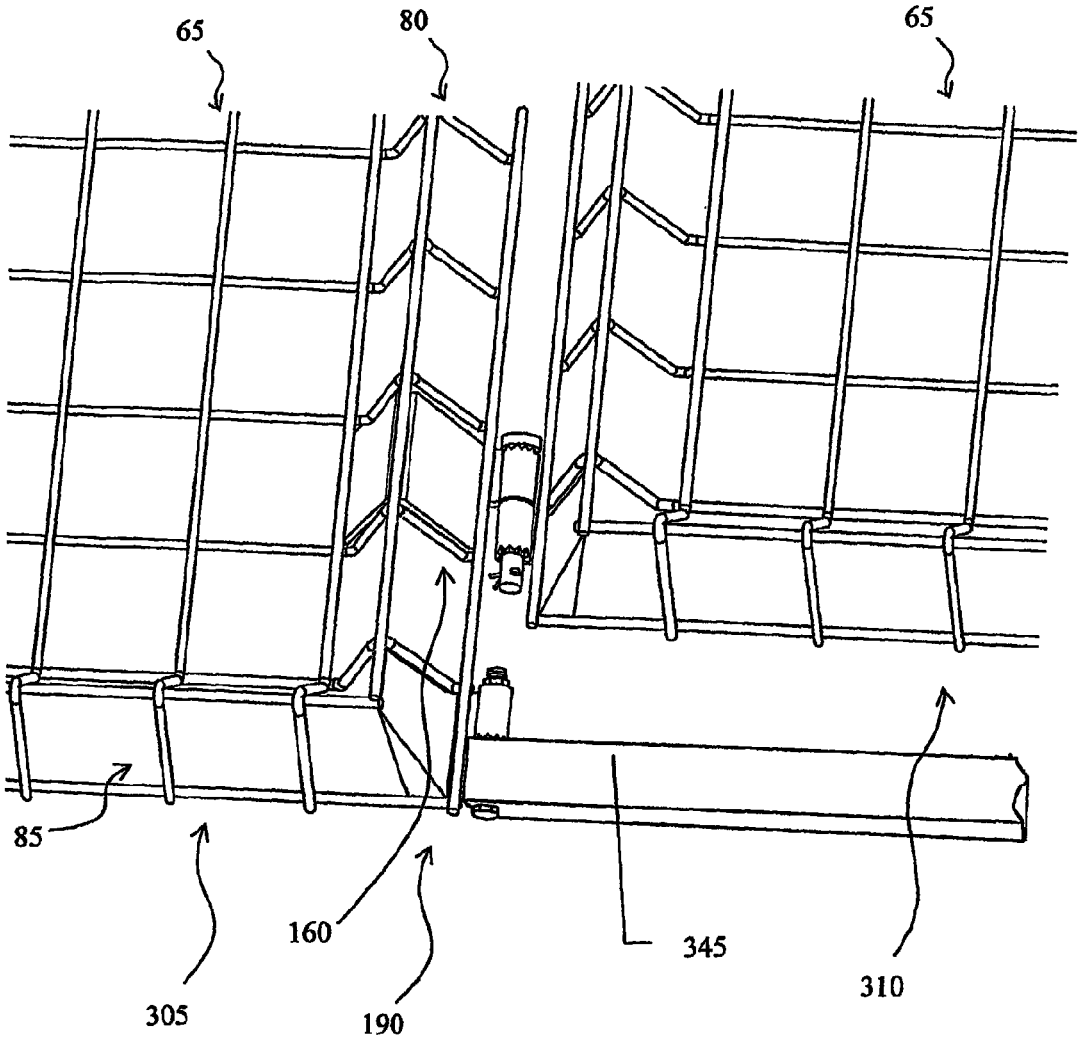
FIG. 24 is a section view taken along line 24 in FIG. 25, and shows still another of the many embodiments and locations of a riser, two joining devices, and multiple fence panels.

FIG. 24 shows a riser tube 345 that may be formed from metal, plastic, wood, or similar materials positioned and connected to the joining device 190 in a non-rotating manner (by engagement of teeth; in other embodiments, this connection could be provided as confronting smooth surfaces that would make the joint rotatable). A joining device 160 is shown connecting a sidewall 305 to a gate or door 310 in a rotating manner.

Figures 24, 25:
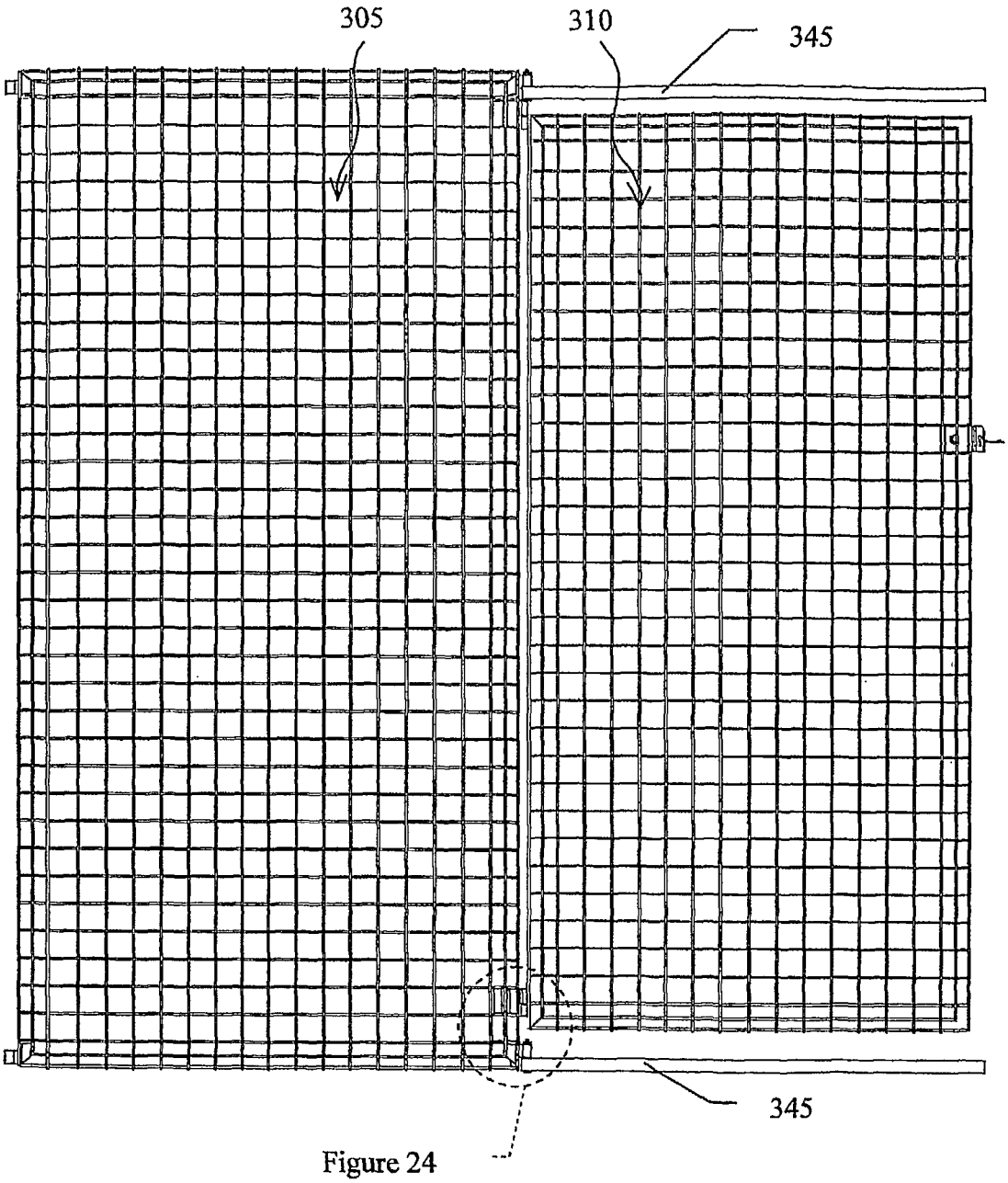
FIG. 25 is a side view showing another of the many alternative embodiments of the invention, and the location of risers, joining devices, and multiple fence panels.

FIG. 25 shows the preferred positioning of the joining devices shown in FIG. 24 and the preferred positioning of the riser 345 relative to a sidewall 305 and gate or door 310. Persons of ordinary skill in the art will understand that other positioning and connectivity arrangements are possible without deviating from the teachings of the invention, as described herein.

Figure 26A:
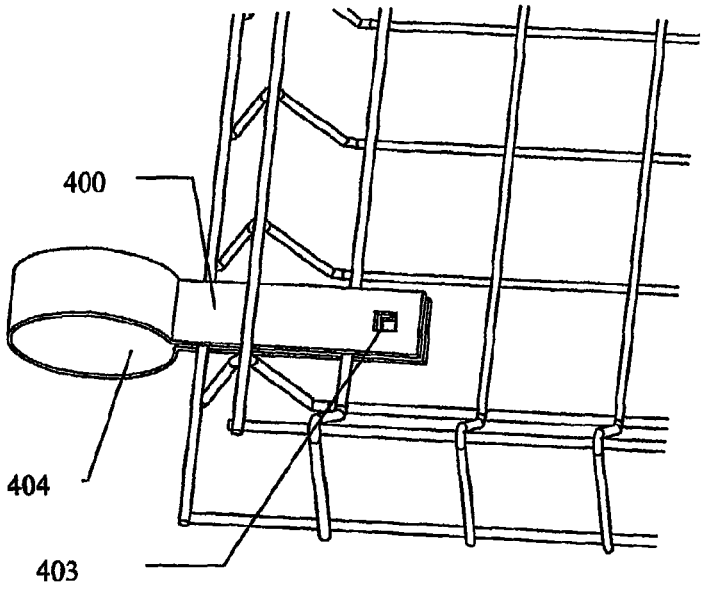
FIGS. 26(*a*)-(*b*) illustrate some of the many alternative embodiments of joining devices of the invention.
Figure 26B:
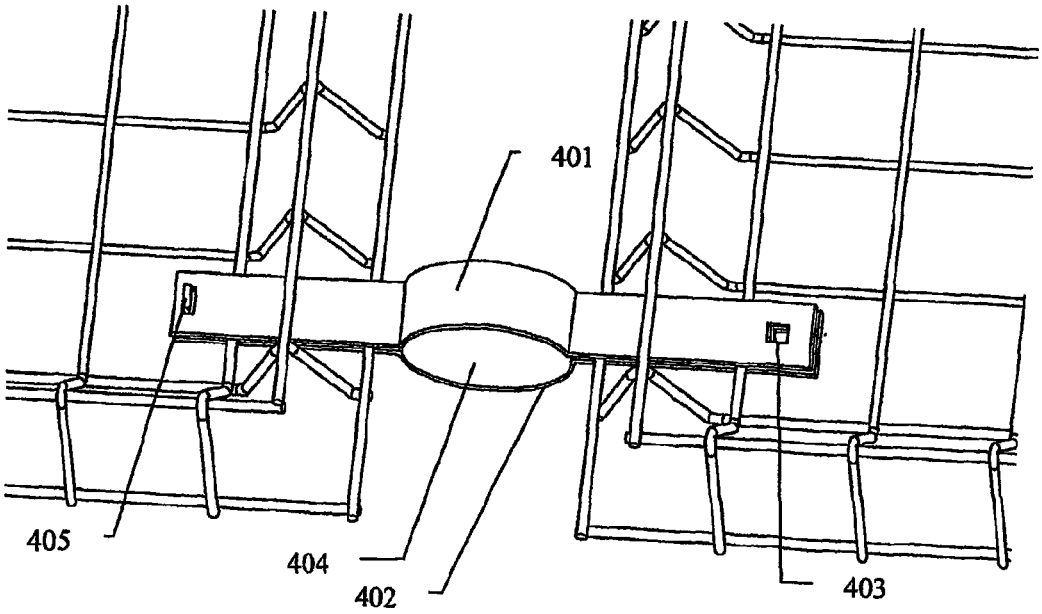

Other of the many examples of joining device embodiments for joining together adjacent fence panels of the invention include those shown in FIGS. 26(*a*)-(*b*) and 27-28. For example, a joining device for joining fence panels, as described herein, to a post or frame structure is shown in FIGS. 26(*a*)-(*b*). The joining device of FIGS. 26(*a*)-(*b*) permits adjacent fence panels to attach to each other in a variety of patterns, as described above. In the embodiment illustrated in FIG. 26(*a*), the parallel portions 400 of the joining device can be inserted around opposite sides of a panel and joined by bolts, rivets, or other means, such as through hole 403. In FIG. 26(*b*), two brace halves 401 and 402 can be placed on opposite sides of a panel and joined by interlocking tab 405 and by bolts, rivets or other means, such as through holes 403 (as described above). The brace 400 and two halves 401 and 402 preferably are configured to form a circular or other suitable opening 404 in which a pole or post or other support member can be positioned to hold the fence panel upright or in another desired configuration. FIG. 26(*a*) can be used to join a single panel to a post, while FIG. 26(*b*) can be used to join multiple panels to a post/pole.

Figure 27:
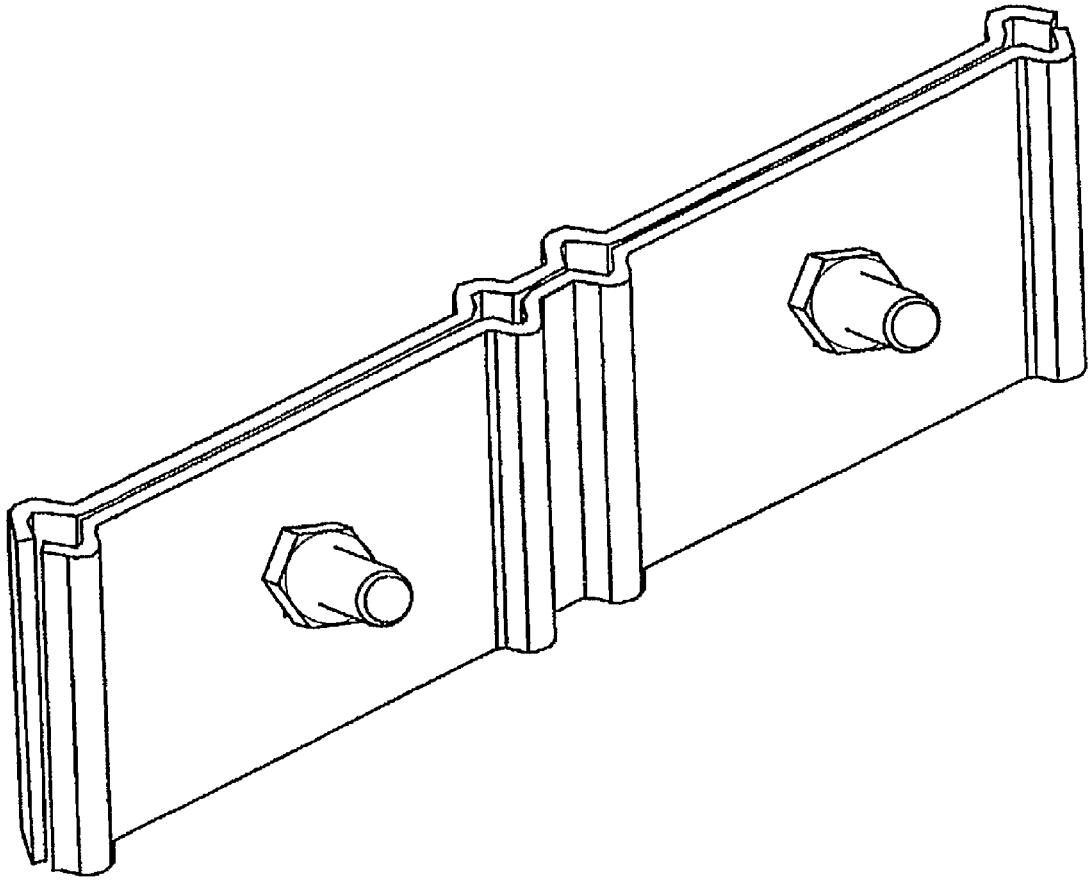
FIG. 27 is a perspective view that illustrates a still further alternative joining device embodiment.
Figure 28:
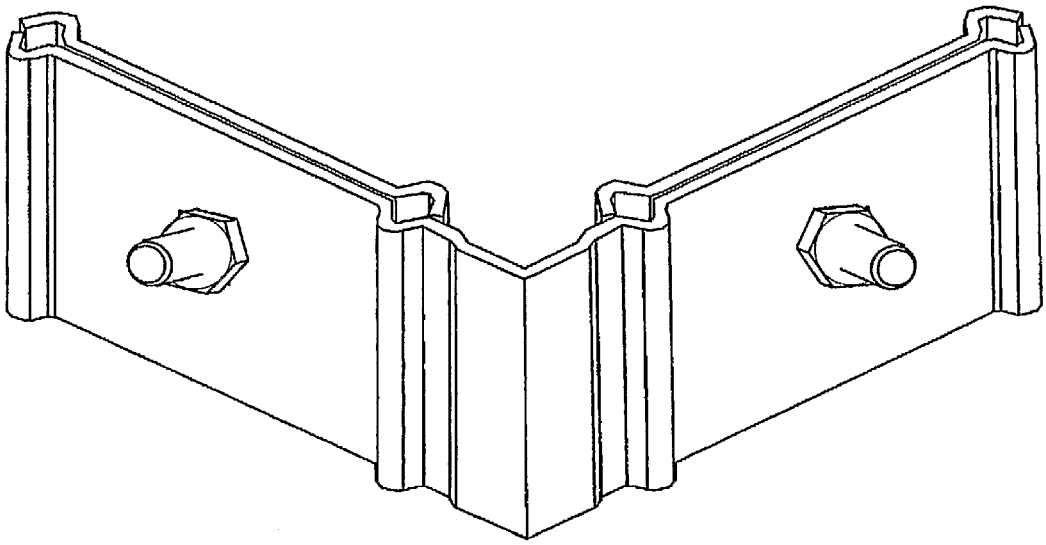
FIG. 28 is a perspective view that shows yet another alternative embodiment of a joining device.

The joining device of FIGS. 27-28 permits adjacent fence panels to be joined in a generally straight line (FIG. 27) or at an angle to each other (FIG. 28). The latter might be used, for example, at a corner of an enclosure. Persons of ordinary skill in the art will understand that the general operation and assembly of the devices of FIGS. 27 and 28 preferably are similar to that described above in connection with FIG. 18 (bolting or otherwise affixing two halves to selected locations on the wire panel, etc.).

Figure 29A:
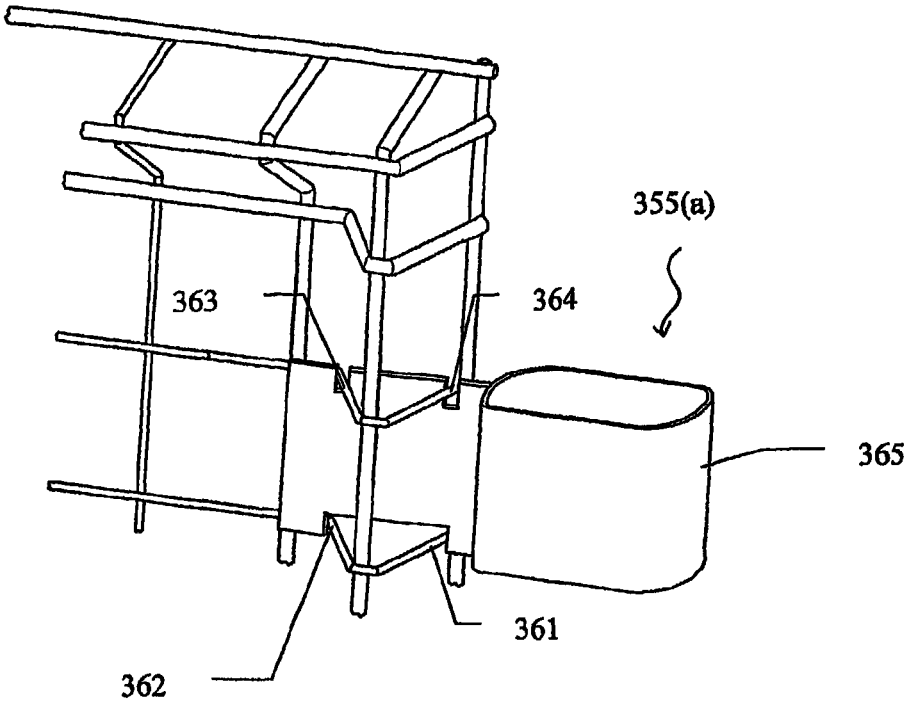
FIGS. 29(*a*)-(*b*) illustrate further variations or brackets or joining device in accordance with one of the many other embodiments of the present invention.
Figure 29B:
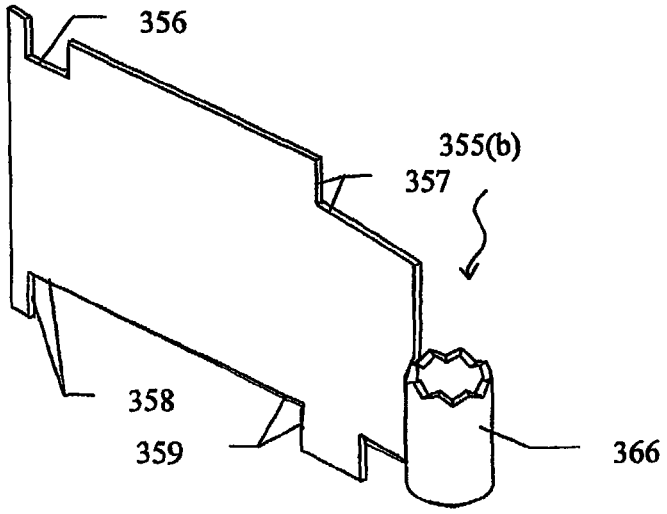

FIGS. 29(*a*)-(*b*) illustrate yet another alternative joining device. These include exemplary brackets 355(*a*)-(*b*) that may be joined to the fence panel via an interference/friction fit, rather than by bolting or otherwise fastening two halves of a brace or bracket to the fence panel. In FIGS. 29(*a*)-(*b*), the brackets 355(*a*)-(*b*) can be inserted into the panel at approximately a forty-five degree angle (not shown) to the wires 10, 15, and then the brackets 355(*a*)-(*b*) can be rotated into a position parallel to the main plane 70 of the panel (such as shown in FIG. 29(*a*)), until the brackets 355(*a*)-(*b*) are locked into place. In other words, the brackets 355(*a*)-(*b*) may be popped securely into place between the spaced-apart wires 10, 15 of the panel 65. By forming the brackets 355(*a*)-(*b*) with appropriate dimensions (corresponding to the spacing of wires within the panel), the slots/edges 356, 357, 358, 359 can be frictionally, and/or otherwise interferingly, engaged with wires such as wires 361-364.

Likewise, the joining device shown in FIGS. 34(*a*)-(*h*) is done via insertion of the joining device 500 between the spaced-apart wires 10, 15. As shown in those figures the joining device is inserted so as to contact the spaced-apart wire 505 that forms the top of the bend. In this manner the joining device 500 may strengthen the bend 80, 85 by reducing the bend's tendency to flex open or closed.

Persons of ordinary skill in the art will understand that any desired element can be formed on the other end of the joining/engagement elements 355, 500, including a post/pole receiver 365 (FIG. 29(*a*)), a toothed/smooth tubular portion 366 (FIG. 29(*b*)), other friction/interfering structures (like that of (FIG. 29(*a* or *b*)), any of the other connectors described herein, or any other desired structures.

Other joining members 505, 506 may be configured or adapted to join with the first bend 80, the second bend 85, or V-shaped insert 155. Attaching or securing the joining member 505, 506 to the bend 80, 85, or insert 155 may be accomplished in a variety of methods including the use of a bolt 507 and nut 508 shown in FIGS. 36(*c*) and 36(*d*).

Figure 30:
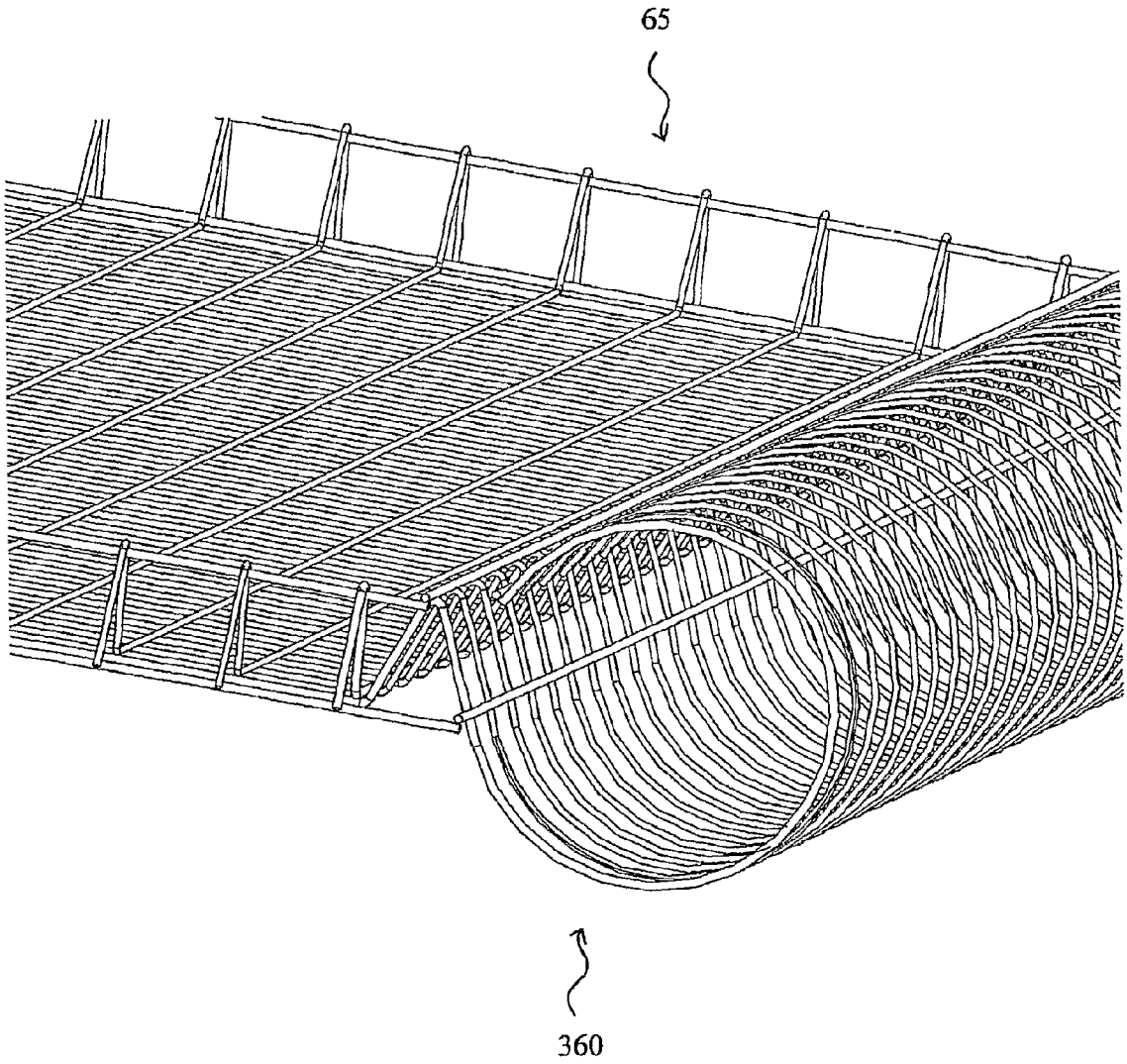
FIG. 30 shows a substantially cylindrical end unit or portion formed in a fence panel.

The alternative embodiment of FIG. 30 shows further extensions and bending of the fence panel 65 to form a substantially cylindrical end unit 360 that may be used to house or connect the panel to a pipe or pipe segments, or act as a protective barrier. Among other things, the coiled end portion may be coupled and/or interwoven with another like coiled portion on a similar piece of fencing. In one embodiment, a single pole may be positioned through coils or similar elements on both fence panels at the same time to "lock", or otherwise assemble, the pieces to each other (depending on the application and configuration of the coupling, the joint between panels can provide pivoting or be fixed). Persons of ordinary skill in the art will understand that the end(s) of the invention's fence panel may be bent into any number of configurations as may be needed to satisfy virtually any residential or commercial application.

As mentioned above, although the invention primarily has been described and illustrated as having bends positioned at or near the edge of the fence panel, persons of ordinary skill in the art will understand that the bends and "heavier gauge" wires of the invention can be located at any suitable position on the fence panel, including (by way of example and not by way of limitation) through the middle of the panel, and/or with multiple bends (generally parallel with each other or otherwise) spaced across a single panel at desired regular or irregular intervals. In that regard, persons of ordinary skill in the art also will understand that the heavier wires preferably are positioned within the mesh at those locations at which the bends are located (to further increase the strength of the panel), but they could be located elsewhere within the panel (other than at the bend locations) or could be left out entirely for panels to be used in less demanding applications.

Methods of the invention include not only the various manufacturing methods described above, but also methods of selecting and assembling the various components discussed herein, into any of the wide variety of assemblies in which the invention can be practiced. Further methods include methods of crowd control, methods of animal control, methods of providing safety or security, or the like, using the apparatus of the invention. Steps for such methods include, by way of example and not by way of limitation, providing at least one panel of the invention, operatively positioning it for the desired purpose and application, engaging it to another element or another panel to help maintain it in its desired position, and other steps. For many applications, the invention will provide much simpler inventory, assembly, and breakdown of temporary or "semi-permanent" fencing than can be accomplished with prior art approaches.

Although the method of the present invention is described herein as occurring in a certain order, the specific order of the steps, or any continuation or interruption between steps, is not required.

The apparatus and methods of the present invention have been described with some particularity, but the specific designs, constructions and steps disclosed are not to be taken as delimiting of the invention. Obvious modifications will make themselves apparent to those of ordinary skill in the art, all of which will not depart from the essence of the invention and all such changes and modifications are intended to be encompassed within the appended claims.

What is claimed is:

1. A method of fabricating a fence panel having a generally planar surface formed by spaced apart wires, including the steps of:

(1) providing a first set of generally parallel wires generally spaced apart from each other, and a second set of generally parallel wires generally spaced apart from each other and generally transverse to the first set of wires so as to form a plurality of intersections therewith;

(2) cutting a portion of the spaced apart wires at least one of the transverse intersections between the first set of parallel wires and the second set of parallel wires;

(3) removing the cut portion; and (4) bending the panel to form a first bend and a second bend integral with the surface, the bends each constituting a deformation of the panel both out of the panel's generally planar surface and back toward the generally planar surface, a first deformation having a substantially uniform cross-section generally continuously along the length of the first bend in a first direction, and a second deformation having a substantially uniform cross-section generally continuously along the length of the second bend in a second direction not parallel to the first direction;

(5) joining together at least one pair of the intersecting wires that comprise the first bend and the second bend so that the first bend and second bend intersect to form a junction and wherein the junction protrudes from the panel's generally planar surface.

2. The method of claim 1, further including connecting a support link between spaced apart wires in the area of the joined wires.

3. The method of claim 1, further including fabricating a plurality of such panels having similarly sized and shaped bend deformations so that the panels are nestable with each other.

4. The method of claim 3, further including providing hinge means for providing a rotatable relationship between at least two adjacent panels.

5. The method of claim 3, further including providing at least one a door portion in at least one of said panels.

6. The method of claim 5, wherein the door portion includes a pipe frame.

7. A method of making a fence panel, comprising the steps of:

providing a first set of generally parallel spaced apart wires;

providing a second set of generally parallel spaced apart wires;

positioning the second set of wires generally transverse to the first set of wires to form points of transverse intersection between the first set of wires and the second set of wires;

connecting the first set of wires to the second set of wires along a plurality of points of transverse intersection, to thereby form junctions;

cutting a portion of the first set of wires and the second set of wires;

removing the cut portion;

bending the first set of wires and the second set of wires to deform the fence panel both out of the panel's generally planar surface and back toward that generally planar surface, each of the deformations comprising a generally uniform cross-section generally continuously along a sufficient distance to stiffen the panel against bending along an axis that is not parallel to the respective bend, wherein each of the deformations extends in a direction that is not parallel to the other; and connecting at least one pair of the first and second sets of wires to each other at a point at which they transversely intersect each other, said connection point being at an intersection that is positioned out of the panel's generally planar surface.

8. The method of claim 7, further including the step of:

positioning at least a portion of the first set of parallel spaced apart wires an approximately equal distance from each other; and positioning at least a portion of the second set of parallel spaced apart wires an approximately equal distance from each other.

9. The method of claim 8, wherein the step of positioning the second set of parallel spaced apart wires transverse to the first set of wires further includes positioning the first set of wires traverse the second set of wires at an approximately right angle.

10. The method of claim 9, wherein the step of providing a first set of parallel spaced apart wires further includes the step of placing wires of different gauges within the first set.

11. The method of claim 10, wherein the step of providing a second set of parallel spaced apart wires includes the step of placing wires of different gauges within the second set.

12. The method of claim 11, further including the step of positioning larger gauge wires within the first set and second set of parallel spaced apart wires so that the larger gauge wires are selectively positioned to be deformed out of the panel's generally planar surface as part of the first bend and the second bend.

13. The method of claim 7, wherein the step of positioning the second set of wires transverse to the first set of wires includes the step of weaving the first set of wires along the second set of wires.

* * * * *